US007944418B2

(12) United States Patent
Chung et al.

(10) Patent No.: US 7,944,418 B2
(45) Date of Patent: May 17, 2011

(54) DATA DRIVING CIRCUITS CAPABLE OF DISPLAYING IMAGES WITH UNIFORM BRIGHTNESS AND DRIVING METHODS OF ORGANIC LIGHT EMITTING DISPLAYS USING THE SAME

(75) Inventors: Bo Yong Chung, Seoul (KR); Do Hyung Ryu, Gyeonggi-do (KR); Hong Kwon Kim, Euiwang-si (KR); Oh Kyong Kwon, Seoul (KR)

(73) Assignees: Samsung Mobile Display Co., Ltd., Suwon-si, Gyeonggi-do (KR); IUCF-HYU—Hanyang University, Seoul (KR)

( * ) Notice: Subject to any disclaimer, the term of this patent is extended or adjusted under 35 U.S.C. 154(b) by 1318 days.

(21) Appl. No.: 11/492,016

(22) Filed: Jul. 25, 2006

(65) Prior Publication Data

US 2007/0024544 A1 Feb. 1, 2007

(30) Foreign Application Priority Data

Aug. 1, 2005 (KR) ..... 10-2005-0070437

(51) Int. Cl.
*G09G 3/32* (2006.01)

(52) U.S. Cl. ..... 345/82; 315/169.3

(58) Field of Classification Search ..... 345/36, 345/39, 44–46, 74.1–83; 315/169.3; 313/463
See application file for complete search history.

(56) References Cited

U.S. PATENT DOCUMENTS 6,710,548 B2 3/2004 Kimura
6,806,497 B2 10/2004 Jo
6,809,706 B2 10/2004 Shimoda
6,859,193 B1 2/2005 Yumoto
6,873,117 B2 3/2005 Ishizuka
7,030,842 B2 4/2006 Ha et al.
(Continued)

FOREIGN PATENT DOCUMENTS

EP 1 796 070 6/2007
(Continued)

OTHER PUBLICATIONS

Hai-Jung In, et al., "A Novel Volage-Programming Pixel with Current-Correction Method for Lage-Size and High-Resoluation AMOLEDs on Poly-Si Backplane", International Meeting on Information Display, IMID'05 Digest, No. 286, pp. 901-904 (Jul. 23, 2005).

(Continued)

*Primary Examiner* — Chanh Nguyen
*Assistant Examiner* — Ram A Mistry
(74) *Attorney, Agent, or Firm* — Lee & Morse, P.C.

(57) ABSTRACT

A data driving circuit for a light emitting display may include a gamma voltage generator that generates gradation voltages, a current sink that receives a predetermined current from a pixel via a data line during a first partial period of one complete period for driving the pixel, a voltage generator that generates an incrementally increasing compare voltage during the first partial period, a comparator that compares a compensation voltage generated based on the predetermined current with the compare voltage and generates a logic signal based on a result of the compare, an adjusting unit that generates compensation data based on the logic signal, and a digital-analog converter that generates a composite data using the compensation data and externally supplied data and selects, as a data signal for the pixel, one of the plurality of gradation voltages based on a bit value of the composite data.

20 Claims, 11 Drawing Sheets

U.S. PATENT DOCUMENTS

| | | | | |
|---|---|---|---|---|
| 7,113,156 | B2 | 9/2006 | Hashimoto | |
| 7,432,891 | B2 | 10/2008 | Fruehauf | |
| 7,719,492 | B2 * | 5/2010 | Childs | 345/76 |
| 2003/0058213 | A1 * | 3/2003 | Okada | 345/96 |
| 2003/0189541 | A1 | 10/2003 | Hashimoto | |
| 2004/0104870 | A1 | 6/2004 | Mametsuka | |
| 2005/0156828 | A1 * | 7/2005 | Yamashita et al. | 345/76 |
| 2005/0156837 | A1 * | 7/2005 | Kasai | 345/77 |
| 2008/0030438 | A1 | 2/2008 | Marx et al. | |

FOREIGN PATENT DOCUMENTS

| | | | |
|---|---|---|---|
| JP | 10-254410 | A | 9/1998 |
| JP | 2002-311898 | A | 10/2002 |
| JP | 2003-043993 | A | 2/2003 |
| JP | 2003-058106 | A | 2/2003 |
| JP | 2003-140613 | A | 5/2003 |
| JP | 2003-295828 | A | 10/2003 |
| JP | 2004-004675 | A | 1/2004 |
| JP | 2004-125852 | A | 4/2004 |
| JP | 2004-145197 | A | 5/2004 |
| JP | 2004-192000 | A | 7/2004 |
| JP | 2004-287345 | A | 10/2004 |
| JP | 2007-519956 | A | 7/2007 |
| JP | 2007-536585 | T | 12/2007 |
| JP | 2008-504576 | A | 2/2008 |
| KR | 10-2003-0081080 | | 10/2003 |
| KR | 10-2004-0061902 | | 7/2004 |
| WO | WO 2005/029456 | | 3/2005 |
| WO | WO 2005-069267 | A1 | 7/2005 |
| WO | WO 2006-000101 | A1 | 1/2006 |

OTHER PUBLICATIONS

Y. Matsueda, et al., "AMOLED with Integrated 6-Bit Gamma Compensated Digital Data Driver", 2004 SID International Symposium, SID 04 Digest, pp. 1116-1119 (May 25, 2004).

* cited by examiner

DATA DRIVING CIRCUITS CAPABLE OF DISPLAYING IMAGES WITH UNIFORM BRIGHTNESS AND DRIVING METHODS OF ORGANIC LIGHT EMITTING DISPLAYS USING THE SAME

BACKGROUND OF THE INVENTION

1. Field of the Invention

The present invention relates to data driving circuits, light emitting displays employing such data driving circuits and methods of driving the light emitting displays. More particularly, the invention relates to data driving circuits capable of displaying images with uniform brightness, a light emitting display using such a data driving circuit and methods of driving the light emitting display to display images with uniform brightness.

2. Description of Related Art

Flat panel displays (FPDs), which are generally lighter and more compact than cathode ray tubes (CRTs), are being developed. FPDs include liquid crystal displays (LCDs), field emission displays (FEDs), plasma display panels (PDPs) and light emitting displays.

Light emitting displays may display images using organic light emitting diodes (OLEDs) that generate light when electrons and holes re-combine. Light emitting displays generally have fast response times and consume relatively low amounts of power.

FIG. 1 illustrates a schematic of the structure of a known light emitting display.

As shown in FIG. 1, the light emitting display may include a pixel unit 30, a scan driver 10, a data driver 20 and a timing controller 50. The pixel unit 30 may include a plurality of pixels 40 connected to scan lines S1 to Sn and data lines D1 to Dm. The scan driver 10 may drive the scan lines S1 to Sn. The data driver 20 may drive the data lines D1 to Dm. The timing controller 50 may control the scan driver 10 and the data driver 20.

The timing controller 50 may generate data driving control signals DCS and scan driving control signals SCS based on externally supplied synchronizing signals (not shown). The data driving control signals DCS may be supplied to the data driver 20 and the scan driving control signals SCS may be supplied to the scan driver 10. The timing controller 50 may supply data DATA to the data driver 20 in accordance with externally supplied data (not shown).

The scan driver 10 may receive the scan driving control signals SCS from the timing controller 50. The scan driver 10 may generate scan signals (not shown) based on the received scan driving control signals SCS. The generated scan signals may be sequentially supplied to the pixel unit 30 via the scan lines S1 to Sn.

The data driver 20 may receive the data driving control signals DCS from the timing controller 50. The data driver 20 may generate data signals (not shown) based on the received data DATA and data driving control signals DCS. Corresponding ones of the generated data signals may be supplied to the data lines D1 to Dm in synchronization with respective ones of the scan signals being supplied to the scan lines S1 to Sn.

The pixel unit 30 may be connected to a first power source ELVDD for supplying a first voltage VDD and a second power source ELVSS for supplying a second voltage VSS to the pixels 40. The pixels 40, together with the first voltage VDD signal and the second voltage VSS signal, may control the currents that flow through respective OLEDs in accordance with the corresponding data signals. The pixels 40 may thereby generate light based on the first voltage VDD signal, the second voltage VSS signal and the data signals.

In known light emitting displays, each of the pixels 40 may include a pixel circuit including at least one transistor for selectively supplying the respective data signal and the respective scan signal for selectively turning on and turning off the respective pixel 40 of the light emitting display.

Each pixel 40 of a light emitting display is to generate light of predetermined brightness in response to various values of the respective data signals. For example, when the same data signal is applied to all the pixels 40 of the display, it is generally desired for all the pixels 40 of the display to generate the same brightness. The brightness generated by each pixel 40 is not, however, only dependent on the data signal, but is also dependent on characteristics of each pixel 40, e.g., threshold voltage of each transistor of the pixel circuit.

Generally, there are variations in threshold voltage and/or electron mobility from transistor to transistor such that different transistors have different threshold voltages and electron mobilities. The characteristics of transistors may also change over time and/or usage. For example, the threshold voltage and electron mobility of a transistor may be dependent on the on/off history of the transistor.

Therefore, in a light emitting display, the brightness generated by each pixel in response to respective data signals depends on the characteristics of the transistor(s) that may be included in the respective pixel circuit. Such variations in threshold voltage and electron mobility may prevent and/or hinder the uniformity of images being displayed. Thus, such variations in threshold voltage and electron mobility may also prevent the display of an image with a desired brightness.

Although it may be possible to at least partially compensate for differences between threshold voltages of the transistors included in the pixels by controlling the structure of the pixel circuits of the pixels 40, circuits and methods capable of compensating for the variations in electron mobility are still needed. OLEDs that are capable of displaying images with uniform brightness irrespective of variations in electron mobility are also desired.

SUMMARY OF THE INVENTION

The present invention is therefore directed to a data driving circuit and a light emitting display using the same, which substantially overcome one or more of the problems due to the limitations and disadvantages of the related art.

It is therefore a feature of an embodiment of the present invention to provide a data driving circuit capable of driving pixels of a light emitting display to display images with uniform brightness, a light emitting display using the same, and a method of driving the light emitting display.

At least one of the above and other features and advantages of the present invention may be realized by providing a data driving circuit for driving a pixel of a light emitting display based on k-bit externally supplied data for the pixel, where k is a natural number, wherein the pixel is electrically connectable to the driving circuit via a data line, the data driving circuit including a gamma voltage generator generating a plurality of gradation voltages, a current sink receiving a predetermined current from the pixel via the data line during a first partial period of one complete period for driving the pixel, a voltage generator generating an incrementally increasing compare voltage during the first partial period of the one complete period, a comparator comparing a compensation voltage generated based on the predetermined current with the incrementally increasing compare voltage and generating a logic signal based on a result of the compare, a compensation unit generating p-bit compensation data based on the logic signal, where p is a natural number, and a digital-analog converter generating a composite data using the p-bit compensation data and the k-bit externally supplied data and selecting, as a data signal for the pixel, one of the plurality of gradation voltages based on a bit value of the composite data.

The data driving circuit may include a switching unit supplying the selected data signal to the data line during a second partial period of the one complete period, and a buffer arranged between the digital-converter and the switching unit. The gamma voltage generator may generate 2K+p gradation voltages. The generated composite data may be (k+p) bits and the digital-analog converter may generate the composite data by employing the k-bits of data as higher bits, including a most significant bit, of the (k+p) bit compensation data and employing the p-bits of compensation data as the lower bits, including a least significant bit, of the (k+p) bit compensation data.

The current sink may include a current source for receiving the predetermined current, a first transistor provided between the data line and the comparator, the first transistor being turned on during the first partial period, a second transistor provided between the data line and the current source, the second transistor being turned on during the second partial period, and a capacitor charging the compensation voltage therein.

A value of the predetermined current may be equal to or higher than a value of a minimum current employable by the pixel to emit light of maximum brightness, and the maximum brightness may correspond to a brightness of the pixel when a highest one of the plurality of gradation voltages is applied to the pixel. The voltage generator may include a counter that may generate a count signal based on a clock signal received during the first partial period, a voltage incrementing unit that may incrementally increase a voltage in response to the count signal from the counter and generating the compare voltage, and a buffer arranged between the voltage incrementing unit and the comparator. The compensation unit may include a storage unit, the storage unit may temporarily store the p-bit compensation data, and an adjusting unit, the adjusting unit may increase a bit value of the p-bit compensation data based on the clock signal and transmitting the p-bit compensation data to the storage unit based on the logic signal. The comparator may generate the logic signal when a voltage value of the compare voltage is determined to be greater than or equal to a voltage value of the p-bit compensation voltage.

The switching unit may include at least one transistor that is turned on during the second partial period. The switching unit may include two transistors that are connected to each other so as to form a transmission gate. The data driving circuit may further include a shift register that may sequentially generate a sampling pulse, a sampling latch unit that may include at least one sampling latch for receiving and storing the k-bit externally supplied data based on the sampling pulse, and a holding latch unit that may receive the k-bit externally supplied data stored in sampling latch unit and supplying the k-bit externally supplied data stored in the holding latch unit to the digital-analog converter. The data driving circuit may include a level shifting unit that may increase a voltage level of the k-bit externally supplied data stored in the holding latch unit and supplied the voltage shifted k-bit externally supplied data to the digital-analog converter.

At least one of the above and other features and advantages of the present invention may be separately realized by providing a light emitting display including a pixel unit including a plurality of pixels connected to one of n scan lines, one of a plurality of emission control lines and one of a plurality of data lines, where n is an integer, a scan driver, the scan driver respectively and sequentially supplying, during each scan cycle, n scan signals to the n scan lines, and for sequentially and respectively supplying emission control signals to the emission control lines, and a data driving circuit, the data driving circuit may generate compensation voltages based on predetermined currents flowing to the data lines from the pixels, respectively, during a first partial period of one complete period during which one of n scan signals is applied to the respective one of the n scan lines, generate a plurality of compensation data using the generated compensation voltages and externally supplied data, select one of a plurality of gradation voltages based on the generated compensation data and supply the selected one of the plurality of gradation voltages to the respective pixels during a second partial period of the one complete period.

Each of the pixels may be connected to two of the n scan lines, and during each of the scan cycles, a first scan line of the two scan lines receiving a respective one of the n scan signals before a second scan line of the two scan lines receives a respective one of the n scan signals, and each of the pixels may include a light emitter receiving current from a first power source, first and second transistors each having a first electrode connected to the respective one of the data lines associated with the pixel, the first and second transistors being turned on when the first of the two scan signals is supplied, a third transistor having a first electrode connected to a reference power source and a second electrode connected to a second electrode of the first transistor, the third transistor being turned on when the first of the two scan signals is supplied, a fourth transistor that may control an amount of current supplied to the light emitter, a first terminal of the fourth transistor being connected to the first power source, and a fifth transistor having a first electrode connected to a gate electrode of the fourth transistor and a second electrode connected to a second electrode of the fourth transistor, the fifth transistor being turned on when the first of the two scan signals is supplied such that the fourth transistor operates as a diode.

Each of the pixels may further include a first capacitor having a first electrode connected to one of a second electrode of the first transistor and the gate electrode of the fourth transistor and a second electrode connected to the first power source, and a second capacitor having a first electrode connected to the second electrode of the first transistor and a second electrode connected to the gate electrode of the fourth transistor. Each of the pixels may further include a sixth transistor having a first terminal connected to the second electrode of the fourth transistor and a second terminal connected to the organic light emitting diode, the sixth transistor being turned off when the respective emission control signal is supplied, wherein the current sink receives the predetermined current from the pixel during the first partial period of one complete period for driving the pixel based on the selected graduation voltage, the first partial period occurring before a second partial period of the complete period for driving the one pixel based on the selected graduation voltage, and the sixth transistor is turned on during the second partial period of the complete period for driving the pixel.

At least one of the above and other features and advantages of the present invention may be separately realized by providing a method of driving a pixel of a light emitting display based on k-bit externally supplied data for the pixel, wherein the pixel is electrically connectable to a driving circuit via a data line, the method may include receiving a predetermined current from the pixel via the data line during a first partial period of one complete period for driving the pixel, generating an incrementally increasing compare voltage during the first partial period of the one complete period, comparing a compensation voltage generated based on the predetermined current with the incrementally increasing compare voltage and generating a logic signal based on a result of the compare, generating p-bit compensation data based on the logic signal, where p is a natural number, generating a composite data using the p-bit compensation data and the k-bit externally supplied data and selecting, as a data signal for the pixel, one of a plurality of gradation voltages based on a bit value of the composite data, where k is a natural number, and supplying the selected data signal to the pixel via the data line during a second partial period of the one complete period for driving the pixel, the first partial period being different from the second partial period.

Generating the logic signal may involve generating the logic signal when a voltage value of the compare voltage is determined to be greater than or equal to a voltage value of the p-bit compensation voltage. The composite data may be (k+p) bits and generating the composite data may involve employing the k-bits of data DATA as higher bits, including the most significant bit, of the (k+p) bit compensation data and employing the p-bits of compensation data as lower bits, including the least significant bit, of the (k+p) bit compensation data.

BRIEF DESCRIPTION OF THE DRAWINGS

These and other features and advantages of the invention will become apparent to those of ordinary skill in the art by describing in detail exemplary embodiments thereof with reference to the attached drawings in which.

DETAILED DESCRIPTION OF THE INVENTION

Figure 1:
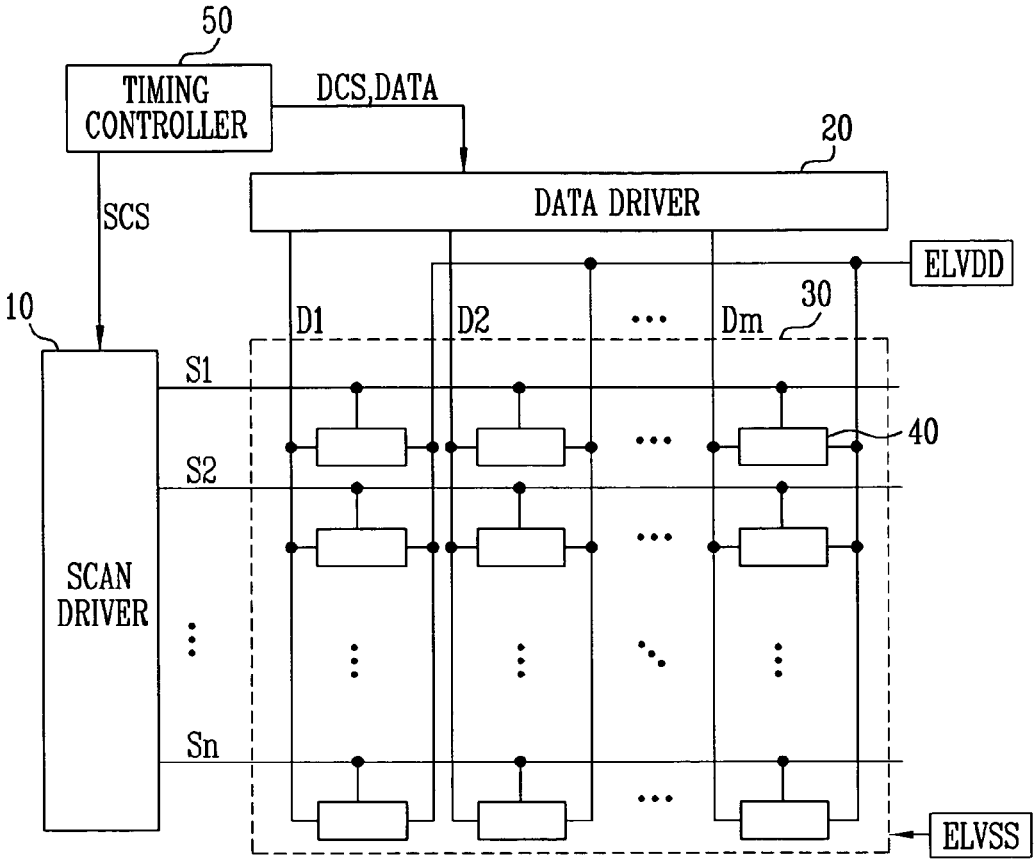
FIG. 1 (RELATED ART)
FIG. 1 illustrates a schematic diagram of a known light emitting display.

Korean Patent Application No. 2005-0070437, filed on Aug. 1, 2005, in the Korean Intellectual Property Office, and entitled, "Data Driving Circuit and Driving Method of Organic Light Emitting Display Using the Same," is incorporated by reference herein in its entirety.

The present invention will now be described more fully hereinafter with reference to the accompanying drawings, in which exemplary embodiments of the invention are shown. The invention may, however, be embodied in different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

Hereinafter, exemplary embodiments of the present invention will be described with reference to FIGS. 2 to 13. In data driving circuits and methods employing one or more as of the invention, a compensation voltage may be generated based on current supplied to a current sink from the respective pixel and the compensation voltage may be used to generate compensation data. The generated compensation data and externally supplied data may be used to generate composite data. Then the composite data may be used to select one gradation voltage out of a plurality of gradation voltages to enable the display of images with uniform brightness regardless of the characteristics, e.g., threshold voltage, mobility, of the transistors.

Figure 2:
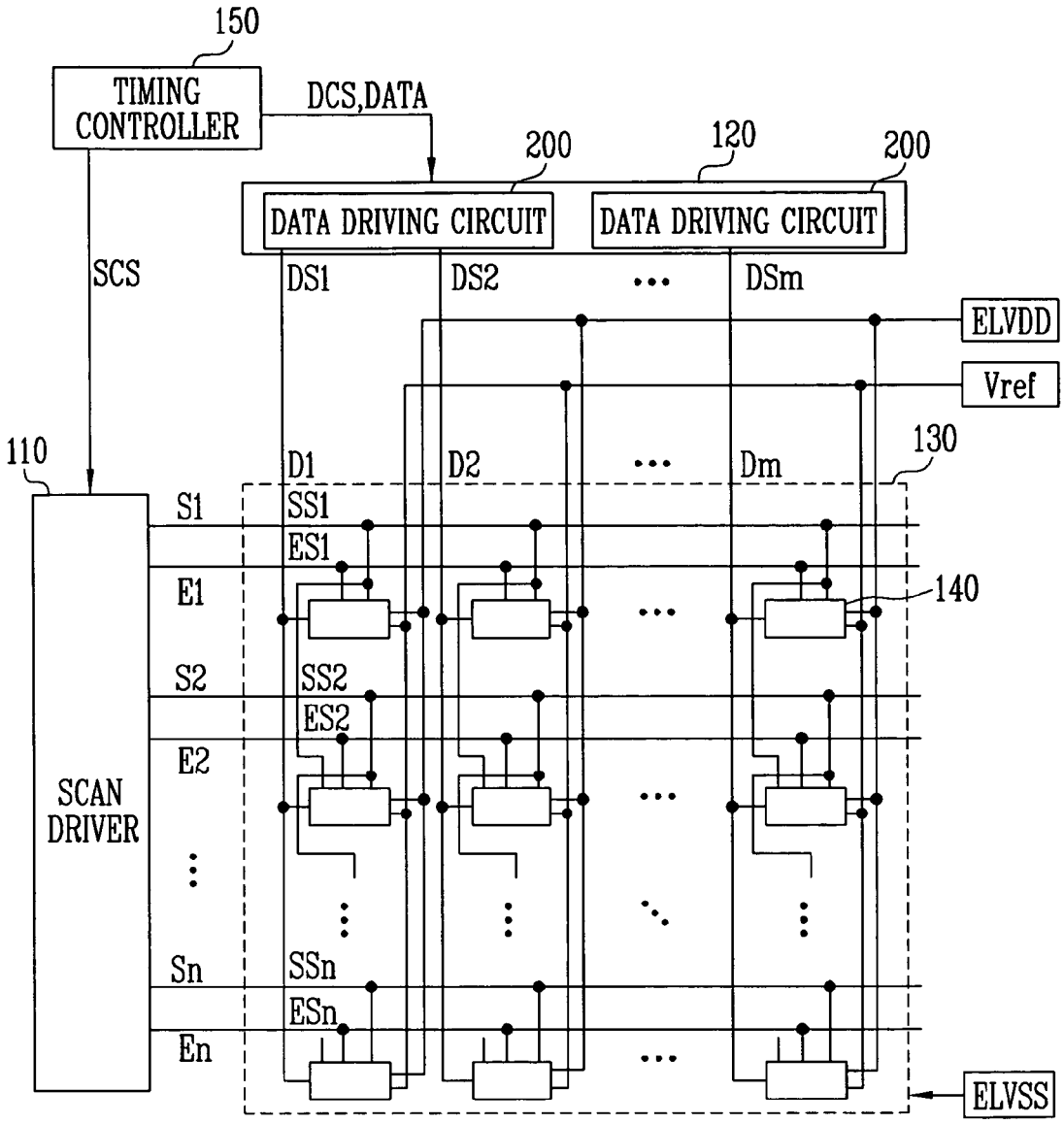
FIG. 2 illustrates a schematic diagram of a light emitting display according to an embodiment of the present invention.

FIG. 2 illustrates a schematic diagram of a light emitting display according to an embodiment of the present invention.

As shown in FIG. 2, the light emitting display may include a scan driver 110, a data driver 120, a pixel unit 130 and a timing controller 150. The pixel unit 130 may include a plurality of pixels 140. The pixel unit 130 may include n×m pixels 140 arranged, for example, in n rows and m columns, where n and m may each be integers. The pixels 140 may be connected to scan lines S1 to Sn, emission control lines E1 to En and data lines D1 to Dm. The pixels 140 may be respectively formed in the regions partitioned by the emission control lines En1 to En and the data lines D1 to Dm. The scan driver 110 may drive the scan lines S1 to Sn and the emission control lines E1 to En. The data driver 120 may drive the data lines D1 to Dm. The timing controller 150 may control the scan driver 110 and the data driver 120. The data driver 120 may include one or more data driving circuits 200.

The timing controller 150 may generate data driving control signals DCS and scan driving control signals SCS in response to externally supplied synchronizing signals (not shown). The data driving control signals DCS generated by the timing controller 150 may be supplied to the data driver 120. The scan driving control signals SCS generated by the timing controller 150 may be supplied to the scan driver 110. The timing controller 150 may supply data DATA to the data driver 120 in accordance with the externally supplied data (not shown).

The scan driver 110 may receive the scan driving control signals SCS from the timing controller 150. The scan driver 110 may generate scan signals SS1 to SSn based on the received scan driving control signals SCS and may sequentially and respectively supply the scan signals SS1 to SSn to the scan lines S1 to Sn. The scan driver 110 may sequentially supply emission control signals ES1 to ESn to the emission control lines E1 to En. Each of the emission control signals ES1 to ESn may be supplied, e.g., changed from a low voltage signal to a high voltage signal, such that an "on" emission control signal, e.g., a high voltage signal, at least partially overlaps at least two of the scan signals SS1 to SSn. Therefore, in embodiments of the invention, a pulse width of the emission control signals ES1 to ESn may be equal to or larger than a pulse width of the scan signals SS1 to SSn.

The data driver 120 may receive the data driving control signals DCS from the timing controller 150. The data driver 120 may generate data signals DS1 to DSm based on the received data driving control signals DCS and the data DATA. The generated data signals DS1 to DSm may be supplied to the data lines D1 to Dm in synchronization with the scan signals SS1 to SSn supplied to the scan lines S1 to Sn. For example, when the $1^{st}$ scan signal SS1 is supplied, the generated data signals DS1 to DSm corresponding to the pixels 140(1)(1 to m) may be synchronously supplied to the $1^{st}$ to the m-th pixels in the $1^{st}$ row via the data lines D1 to Dm, and when the nth scan signal SSn is supplied, the generated data signals DS1 to DSm corresponding to the pixels 140(*n*)(1 to m) may be synchronously supplied to the $1^{st}$ to the m-th pixels in the n-th row via the data lines D1 to Dm.

The data driver 120 may supply predetermined currents to the data lines D1 to Dm during a first period of one horizontal period 1H for driving one or more of the pixels 140. For example, one horizontal period 1H may correspond to a complete period associated with one of the scan signals SS1 to SSn and a corresponding one of the data signals DS1 to DSm being supplied to the respective pixel 140 in order to drive the respective pixel 140. The data driver 120 may supply predetermined voltages to the data lines D1 to Dm during a second period of the one horizontal period. For example, one horizontal period 1H may correspond to a complete period associated with one of the scan signals SS1 to SSn and a corresponding one of the data signals DS1 to DSm being supplied to the respective pixel 140 in order to drive the respective pixel 140. In embodiments of the invention, the data driver 120 may include at least one data driving circuit 200 for supplying such predetermined currents and predetermined voltages during the first and second periods of one horizontal period 1H. In the following description, the predetermined voltages that may be supplied to the data lines D1 to Dm during the second period will be referred to as the data signals DS1 to DSm.

The pixel unit 130 may be connected to a first power source ELVDD for supplying a first voltage VDD, a second power source ELVSS for supplying a second voltage VSS and a reference power source ELVref for supplying a reference voltage Vref to the pixels 140. The first power source ELVDD, the second power source ELVSS and the reference power source ELVref may be externally provided. The pixels 140 may receive the first voltage VDD signal and the second voltage VSS signal, and may control the currents that flow through respective light emitting devices/materials, e.g., OLEDs, in accordance with the data signals DS1 to DSm that may be supplied by the data driver 120 to the pixels 140. The pixels 140 may thereby generate light components corresponding to the received data DATA.

Some or all of the pixels 140 may receive the first voltage VDD signal, the second voltage VSS signal and the reference voltage Vref signal from the respective first, second and reference power sources ELVDD, ELVSS and ELVref. The pixels 140 may compensate for a voltage drop in the first voltage VDD signal and/or threshold voltage(s) using the reference voltage Vref signal. The amount of compensation may be based on a difference between voltage values of the reference voltage Vref signal and the first voltage VDD signal respectively supplied by the reference power source ELVref and the first power source ELVDD. The pixels 140 may supply respective currents from the first power source ELVDD to the second power source ELVSS via, e.g., the OLEDs in response to the respective data signals DS1 to DSm. In embodiments of the invention, each of the pixels 140 may have, for example, the structure illustrated in FIG. 3 or 5.

Figure 3:
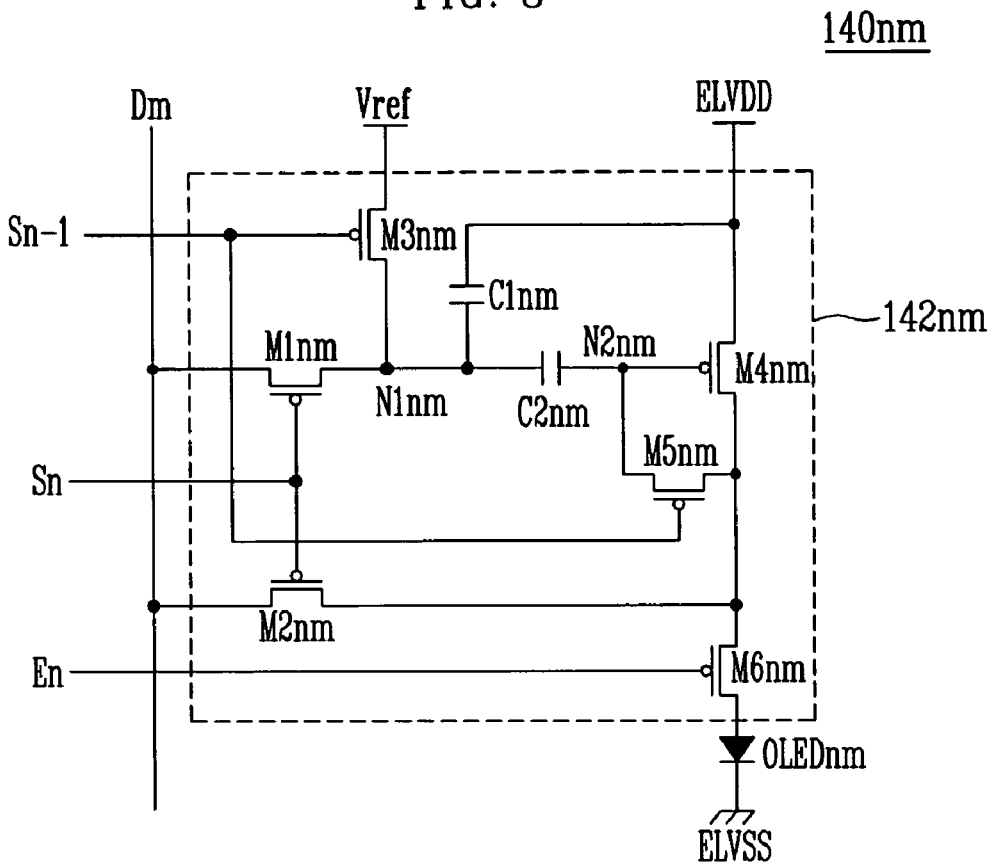
FIG. 3 illustrates a circuit diagram of an exemplary pixel employable in the light emitting display illustrated in FIG. 2.

FIG. 3 illustrates a circuit diagram of an nm-th exemplary pixel 140*nm* employable in the light emitting display illustrated in FIG. 2. For simplicity, FIG. 3 illustrates the nm-th pixel that may be the pixel provided at the intersection of the n-th row of scan lines Sn and the m-th row of data lines Dm. The nm-th pixel 140*nm* may be connected to the m-th data line Dm, the n−1th and nth scan lines Sn-1 and Sn and the nth emission control line En. For simplicity, FIG. 3 only illustrates one exemplary pixel 140*nm*. In embodiments of the invention, the structure of the exemplary pixel 140*nm* may be employed for all or some of the pixels 140 of the light emitting display.

Referring to FIG. 3, the nm-th pixel 140*nm* may include a light emitting material/device, e.g., OLEDnm, and an nm-th pixel circuit 142*nm* for supplying current to the associated light emitting material/device.

The nm-th OLEDnm may generate light of a predetermined color in response to the current supplied from the nm-th pixel circuit 142*nm*. The nm-th OLEDnm may be formed of, e.g., organic material, phosphor material and/or inorganic material.

In embodiments of the invention, the nm-th pixel circuit 142*nm* may generate a compensation voltage for compensating for variations within and/or among the pixels 140 such that the pixels 140 may display images with uniform brightness. The nm-th pixel circuit 142*nm* may generate the compensation voltage using a previously supplied scan signal of the scan signals SS1 to SSn during each scan cycle. In embodiments of the invention, one scan cycle may correspond to scan signals SS1 to SSn being sequentially supplied. Thus, in embodiments of the invention, during each cycle, the n−1th scan signal SSn-1 may be supplied prior to the nth scan signal SSn and when the n−1th scan signal SSn-1 is being supplied to the n−1th scan line of the light emitting display, the nm-th pixel circuit 142*nm* may employ the n−1th scan signal SSn-1 to generate a compensation voltage. For example, the second pixel in the second column, i.e., the 2-2 pixel $\mathbf{140}_{22}$, may generate a compensation voltage using the first scan signal SS1.

The compensation voltage may compensate for a voltage drop in a source voltage signal and/or a voltage drop resulting from a threshold voltage of the transistor of the nm-th pixel circuit 142*nm*. For example, the nm-th pixel circuit 142*nm* may compensate for a voltage drop of the first voltage VDD signal and/or a threshold voltage of a transistor, e.g., a threshold voltage of a fourth transistor M4*nm* of the pixel circuit 142*nm* based on the compensation voltage that may be generated using a previously supplied scan line during the same scan cycle.

In embodiments of the invention, the pixel circuit 142*nm* may compensate for a drop in the voltage of the first power source ELVDD and the threshold voltage of the fourth transistor M4*nm* when the n−1th scan signal SSn-1 is supplied to the n−1th scan line Sn-1, and may charge the voltage corresponding to the data signal when the nth scan signal SSn is supplied to the nth scan line Sn. In embodiments of the invention, the pixel circuit 142*nm* may include first to sixth transistors M1*nm* to M6*nm*, a first capacitor C1*nm* and a second capacitor C2*nm* to generate the compensation voltage and to drive the light emitting material/device.

A first electrode of the first transistor M1*nm* may be connected to the data line Dm and a second electrode of the first transistor M1*nm* may be connected to a first node N1*nm*. A gate electrode of the first transistor M1*nm* may be connected to the nth scan line Sn. The first transistor M1*nm* may be turned on when the nth scan signal SSn is supplied to the nth scan line Sn. When the first transistor M1*nm* is turned on, the data line Dm may be electrically connected to the first node N1*nm*.

A first electrode of the first capacitor C1*nm* may be connected to the first node N1*nm* and a second electrode of the first capacitor C1*nm* may be connected to the first power source ELVDD.

A first electrode of the second transistor M2*nm* may be connected to the data line Dm and a second electrode of the second transistor M2*nm* may be connected to a second electrode of the fourth transistor M4*nm*. A gate electrode of a second transistor M2*nm* may be connected to the nth scan line Sn. The second transistor M2*nm* may be turned on when the nth scan signal SSn is supplied to the nth scan line Sn. When the second transistor M2*nm* is turned on, the data line Dm may be electrically connected to the second electrode of the fourth transistor M4*nm*.

A first electrode of the third transistor M3*nm* may be connected to the reference power source ELVref and a second electrode of the third transistor M3*nm* may be connected to the first node N1*nm*. A gate electrode of the third transistor M3*nm* may be connected to the n−1th scan line Sn-1. The third transistor M3*nm* may be turned on when the n−1th scan signal SSn-1 is supplied to the n−1th scan line Sn-1. When the third transistor M3*nm* is turned on, the reference voltage Vref may be electrically connected to the first node N1*nm*.

A first electrode of the fourth transistor M4*nm* may be connected to the first power source ELVDD and the second electrode of the fourth transistor M4*nm* may be connected to a first electrode of the sixth transistor M6*nm*. A gate electrode of the fourth transistor M4*nm* may be connected to the second node N2*nm*.

A first electrode of the second capacitor C2*nm* may be connected to the first node N1*nm* and a second electrode of the second capacitor C2*nm* may be connected to the second node N2*nm*.

In embodiments of the invention, the first and second capacitors C1*nm* and C2*nm* may be charged when the n−1th scan signal SSn-1 is supplied. In particular, the first and second capacitors C1*nm* and C2*nm* may be charged and the fourth transistor M4*nm* may supply a current corresponding to a voltage at the second node N2*nm* to the first electrode of the sixth transistor M6*nm*.

A second electrode of the fifth transistor M5*nm* may be connected to the second node N2*nm* and a first electrode of the fifth transistor M5*nm* may be connected to the second electrode of the fourth transistor M4*nm*. A gate electrode of the fifth transistor M5*nm* may be connected to the n−1th scan line Sn-1. The fifth transistor M5*nm* may be turned on when the n−1th scan signal SSn-1 is supplied to the n−1th scan line Sn-1 so that current flows through the fourth transistor M4*nm*. Therefore, the fourth transistor M4*nm* may operate as a diode.

The first electrode of the sixth transistor M6*nm* may be connected to the second electrode of the fourth transistor M4*nm* and a second electrode of the sixth transistor M6*nm* may be connected to an anode electrode of the nm-th OLEDnm. A gate electrode of the sixth transistor M6*nm* may be connected to the nth emission control line En. The sixth transistor M6*nm* may be turned off when an emission control signal ESn is supplied, e.g., a high voltage signal, to the nth emission control line En and may be turned on when no emission control signal, e.g., a low voltage signal, is supplied to the nth emission control line En.

In embodiments of the invention, the emission control signal ESn supplied to the nth emission control line En may be supplied to at least partially overlap both the n−1th scan signal SSn-1 that may be supplied to the n−1th scan line Sn-1 and the nth scan signal SSn that may be supplied to nth scan line Sn. Therefore, the sixth transistor M6*nm* may be turned off when the n−1th scan signal SSn-1 is supplied, e.g., a low voltage signal is supplied, to the n−1th scan line Sn-1 and the n-th scan signal SSn is supplied, e.g., a low voltage signal is supplied, to the nth scan line Sn so that a predetermined voltage may be charged in the first and second capacitors C1*nm* and C2*nm*. The sixth transistor M6*nm* may be turned on during other times to electrically connect the fourth transistor M4*nm* and the nm-th OLEDnm to each other. In the exemplary embodiment shown in FIG. 3, the transistors M1*nm* to M6*nm* are PMOS transistors, which may turn on when a low voltage signal is supplied to the respective gate electrode and may turn on when a high voltage signal is supplied to the respective gate electrode. However, the present invention is not limited to PMOS devices.

In the pixel illustrated in FIG. 3, because the reference power source ELVref does not supply current to the pixels 140, a drop in the voltage of the reference voltage Vref may not occur. Therefore, it is possible to maintain the voltage value of the reference voltage Vref signal uniform regardless of the positions of the pixels 140. In embodiments of the invention, the voltage value of the reference voltage Vref may be equal to or different from the first voltage ELVDD.

Figure 4:
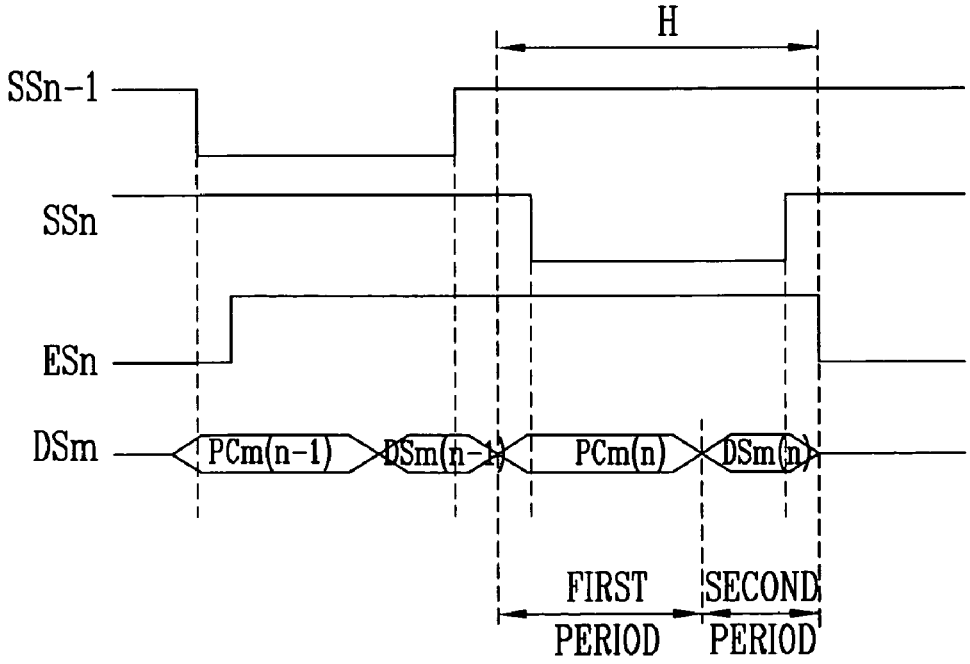
FIG. 4 illustrates exemplary waveforms employable for driving the pixel illustrated in FIG. 3.

FIG. 4 illustrates exemplary waveforms that may be employed for driving the exemplary nm-th pixel 140*nm* illustrated in FIG. 3. As shown in FIG. 4, each horizontal period 1H for driving the nm-th pixel 140*nm* may be divided into a first period and a second period. During the first period, predetermined currents (PCs) may respectively flow through the data lines D1 to Dm. During the second period, the data signals DS1 to DSm may be supplied to the respective pixels 140 via the data lines D1 to Dm. During the first period, the respective PCs may be supplied from each of the pixel(s) 140 to a data driving circuit 200 that may be capable of functioning, at least in part, as a current sink. During the second period, the data signals DS1 to DSm may be supplied from the data driving circuit 200 to the pixel(s) 140. For simplicity, in the following description, it will be assumed that, at least initially, i.e., prior to any voltage drop that may result during operation of the pixels 140, the voltage value of the reference voltage Vref signal is equal to the voltage value of the first voltage VDD signal.

Exemplary methods of operating the nm-th pixel circuit 142*nm* of the nm-th pixel 140*nm* of the pixels 140 will be described in detail with reference to FIGS. 3 and 4. First, the n−1th scan signal SSn-1 may be supplied to the n−1th scan line Sn-1 to control the on/off operation of the m pixels that may be connected to the n−1th scan line Sn-1. When the scan signal SSn-1 is supplied to the n−1th scan line Sn-1, the third and fifth transistors M3*nm* and M5*nm* of the nm-th pixel circuit 142*nm* of the nm pixel 140*nm* may be turned on. When the fifth transistor M5*nm* is turned on, current may flow through the fourth transistor M4*nm* so that the fourth transistor M4*nm* may operate as a diode. When the fourth transistor M4*nm* operates as a diode, the voltage value of the second node N2*nm* may correspond to a difference between the threshold voltage of the fourth transistor M4*nm* and the voltage of the first voltage VDD signal being supplied by the first power source ELVDD.

More particularly, when the third transistor M3*nm* is turned on, the reference voltage Vref signal from the reference power source ELVref may be applied to the first node N1*nm*. The second capacitor C2*nm* may be charged with a voltage corresponding to the difference between the first node N1*nm* and the second node N2*nm*. In embodiments of the invention in which the reference voltage Vref signal from the reference power source ELVref and the first voltage VDD from the first power source ELVDD may, at least initially, i.e., prior to any voltage drop that may result during operation of the pixels 140, be equal, the voltage corresponding to the threshold voltage of the fourth transistor M4*nm* may be charged in the second capacitor C2*nm*. In embodiments of the invention in which a predetermined drop in voltage of the first voltage VDD signal occurs, the threshold voltage of the fourth transistor M4*nm* and a voltage corresponding to the magnitude of the voltage drop of the first power source ELVDD may be charged in the second capacitor C2*nm*.

In embodiments of the invention, during the period where the n−1th scan signal SSn-1 may be supplied to the n−1th scan line Sn-1, a predetermined voltage corresponding to the sum of the voltage corresponding to the voltage drop of the first voltage VDD signal and the threshold voltage of the fourth transistor M4*nm* may be charged in the second capacitor C2*nm*. By storing the voltage corresponding to a sum of the voltage drop of the first voltage VDD signal from the first power source ELVDD and the threshold voltage of the fourth transistor M4*nm* during operation of the respective n−1 pixel of in the m-th column, it is possible to later utilize the stored voltage to compensate for both the voltage drop of the first voltage VDD signal and the threshold voltage during operation of the respective nm-th pixel 140*nm*.

In embodiments of the invention, the voltage corresponding to the sum of the threshold voltage of the fourth transistor M4*nm* and the difference between the reference voltage signal Vref and the first voltage VDD signal may be charged in the second capacitor C2*nm* before the nth scan signal SSn is supplied to the nth scan line Sn. When the nth scan signal SSn is supplied to the nth scan line Sn, the first and second transistors M1*nm* and M2*nm* may be turned on. During the first period of one horizontal period, when the second transistor M2*nm* of the pixel circuit 142*nm* of the nm-th pixel 140*nm* is turned on, the PC may be supplied from the nm-th pixel 140*nm* to the data driving circuit 200 via the data line Dm. In embodiments of the invention, the PC may be supplied to the data driving circuit 200 via the first power source ELVDD, the fourth transistor M4*nm*, the second transistor M2*nm* and the data line Dm. A predetermined voltage may then be charged in the first and second capacitors C1*nm* and C2*nm* in response to the supplied PC.

The data driving circuit 200 may reset a voltage of a gamma voltage unit (not shown) based on a predetermined voltage value, i.e., compensation voltage that may be generated when the PC sinks, as described above. The reset voltage from the gamma voltage unit (not shown) may be used to generate the data signals DS1 to DSm to be respectively supplied to the data lines D1 to Dm.

In embodiments of the invention, the generated data signals DS1 to DSm may be respectively supplied to the respective data lines D1 to Dm during the second period of the one horizontal period. More particularly, e.g., the respective generated data signal DSm may be supplied to the respective first node N1*nm* via the first transistor M1*nm* during the second period of the one horizontal period. Then, the voltage corresponding to difference between the data signal DSm and the first power source ELVDD may be charged in the first capacitor C1*nm*. The second node N2*nm* may then float and the second capacitor C2*nm* may maintain the previously charged voltage.

In embodiments of the invention, during the period when the n−1 pixel in the m-th column is being controlled and the scan signal SSn-1 is being supplied to the previous scan line Sn-1, a voltage corresponding to the threshold voltage of the fourth transistor M4*nm* and the voltage drop of the first voltage VDD signal from the first power source ELVDD may be charged in the second capacitor C2*nm* of the nm-th pixel 140*nm* to compensate for the voltage drop of the first voltage VDD signal from the first power source ELVDD and the threshold voltage of the fourth transistor M4*nm*.

In embodiments of the invention, during the period when the n-th scan signal Sn is supplied to the n-th scan line Sn, the voltage of the gamma voltage unit (not shown) may be reset so that the electron mobility of the transistors included in the respective n-th pixels 140*n* associated with each data line D1 to Dm may be compensated for and the respective generated data signals DS1 to DSm may be supplied to the n-th pixels 140*n* using the respective reset gamma voltages. Therefore, in embodiments of the invention, non-uniformity in the threshold voltages of the transistors and the electron mobility may be compensated, and images with uniform brightness may be displayed. Processes for resetting the voltage of the gamma voltage unit will be described below.

Figure 5:
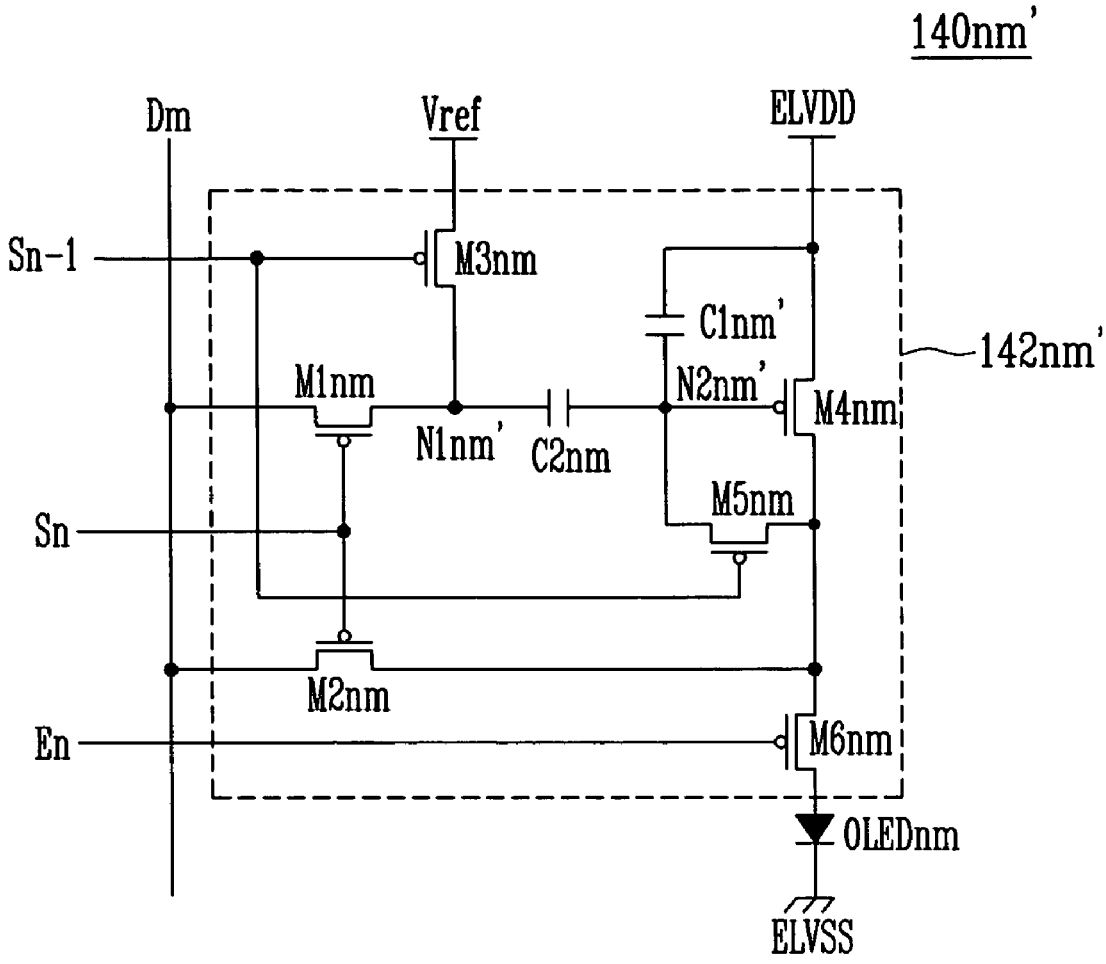
FIG. 5 illustrates a circuit diagram of another exemplary pixel employable in the light emitting display illustrated in FIG. 2.

FIG. 5 illustrates another exemplary embodiment of an nm-th pixel 140*nm*' employable by the light emitting display illustrated in FIG. 2. The structure of the nm-th pixel 140*nm*' illustrated in FIG. 5 is substantially the same as the structure of the nm-th pixel 140*nm* illustrated in FIG. 3, but for the arrangement of a first capacitor C1*nm*' in a pixel circuit 142*nm*' and respective connections to a first node N1*nm*' and a second node N2*nm*'. In the exemplary embodiment illustrated in FIG. 5, a first electrode of the first capacitor C1*nm*' may be connected to the second node N2*nm*' and a second electrode of the first capacitor C1*nm*' may be connected to the first power source ELVDD. A first electrode of the second capacitor C2*nm* may be connected to the first node N1*nm*' and a second electrode of the second capacitor C2*nm* may be connected to the second node N2*nm*'. The first node N1*nm*' may be connected to the second electrode of the first transistor M1*nm*, the second electrode of the third transistor M3*nm* and the first electrode of the second capacitor C2*nm*. The second node N2*nm*' may be connected to the gate electrode of the fourth transistor M4*nm*, the second electrode of the fifth transistor M5*nm*, the first electrode of the first capacitor C1*nm*' and the second electrode of the second capacitor C2*nm*.

In the following description, the same reference numerals employed above in the description of the nm-th pixel 140*nm* shown in FIG. 3 will be employed to describe like features in the exemplary embodiment of the nm-th pixel 140*nm*' illustrated in FIG. 5.

Exemplary methods for operating the nm-th pixel circuit 142*nm*' of the nm-th pixel 140*nm*' of the pixels 140 will be described in detail with reference to FIGS. 4 and 5. First, during a horizontal period for driving the n−1 pixels 140(*n*−1)(1 to m), i.e., the pixels arranged in the (n−1)th row, when the n−1th scan signal SSn-1 is supplied to the n−1th scan line Sn-1, the third and fifth transistors M3*nm* and M5*nm* of the n-th pixel(s) 140(*n*)(1 to m), i.e., the pixels arranged in the n-th row, may be turned on.

When the fifth transistor M5*nm* is turned on, current may flow through the fourth transistor M4*nm* so that the fourth transistor M4*nm* may operate as a diode. When the fourth transistor M4*nm* operates as a diode, a voltage corresponding to a value obtained by subtracting the threshold voltage of the fourth transistor M4*nm* from the first power source ELVDD may be applied to a second node N2*nm*'. The voltage corresponding to the threshold voltage of the fourth transistor M4*nm* may be charged in the first capacitor C1*nm*'. As shown in FIG. 5, the first capacitor C1*nm*' may be provided between the second node N2*nm*' and the first power source ELVDD.

When the third transistor M3*nm* is turned on, the voltage of the reference power source ELVref may be applied to the first node N1*nm*'. Then, the second capacitor C2*nm* may be charged with the voltage corresponding to difference between a first node N1*nm*' and the second node N2*nm*'. During the period where the n−1th scan signal SSn-1 is supplied to the n−1th scan line Sn-1 and the first and second transistors M1*nm* and M2*nm* may be turned off, the data signal DSm may not be supplied to the nm-th pixel 140*nm'*.

Then, during the first period of the one horizontal period for driving the nm-th pixel 140*nm*', the scan signal SSn may be supplied to the nth scan line SSn and the first and second transistors M1*nm* and M2*nm* may be turned on. When the second transistor M2*nm* is turned on, during the first period of the one horizontal period, the respective PC may be supplied from the nm-th pixel 140*nm*' to the data driving circuit 200 via the data line Dm. The PC may be supplied to the data driving circuit 200 via the first power source ELVDD, the fourth transistor M4*nm*, the second transistor M2*nm* and the data line Dm. In response to the PC, predetermined voltage may be charged in the first and second capacitors C1*nm*' and C2*nm*.

The data driving circuit 200 may reset the voltage of the gamma voltage unit using the compensation voltage applied in response to the PC to generate the data signal DS using the respectively reset voltage of the gamma voltage unit.

Then, during the second period of the one horizontal period for driving the nm-th pixel 140*nm*', the data signal DSm may be supplied to the first node N1*nm*'. The predetermined voltage corresponding to the data signal DSm may be charged in the first and second capacitors C1*nm*' and C2*nm*.

When the data signal DSm is supplied, the voltage of the first node N1*nm*' may fall from the voltage Vref of the reference power source ELVref to the voltage of the data signal DSm. At this time, as the second node N2*nm*' may be floating, the voltage value of the second node N2*nm*' may be reduced in response to the amount of voltage drop of the first node N1*nm*'. The amount of reduction in voltage that may occur at the second node N2*nm*' may be determined by the capacitances of the first and second capacitors C1*nm*' and C2*nm*.

When the voltage of the second node N2*nm*' falls, the predetermined voltage corresponding to the voltage value of the second node N2*nm*' may be charged in the first capacitor C1*nm*'. When the voltage value of the reference power source ELVref is fixed, the amount of voltage charged in the first capacitor C1*nm*' may be determined by the data signal DSm. That is, in the nm-th pixel 140*nm*' illustrated in FIG. 5, because the voltage values charged in the capacitors C1*nm*' and C2*nm* may be determined by the reference power source ELVref and the data signal DSm, it may be possible to charge a desired voltage irrespective of the voltage drop of the first power source ELVDD.

In embodiments of the invention, the voltage of the gamma voltage unit may be reset so that the electron mobility of the transistors included in each of the pixels 140 may be compensated for and the respective generated data signal may be supplied using the reset gamma voltage. In embodiments of the invention, non-uniformity among the threshold voltages of the transistors and deviation in the electron mobility of the transistors may be compensated for, thereby enabling images with uniform brightness to be displayed.

Figure 6:
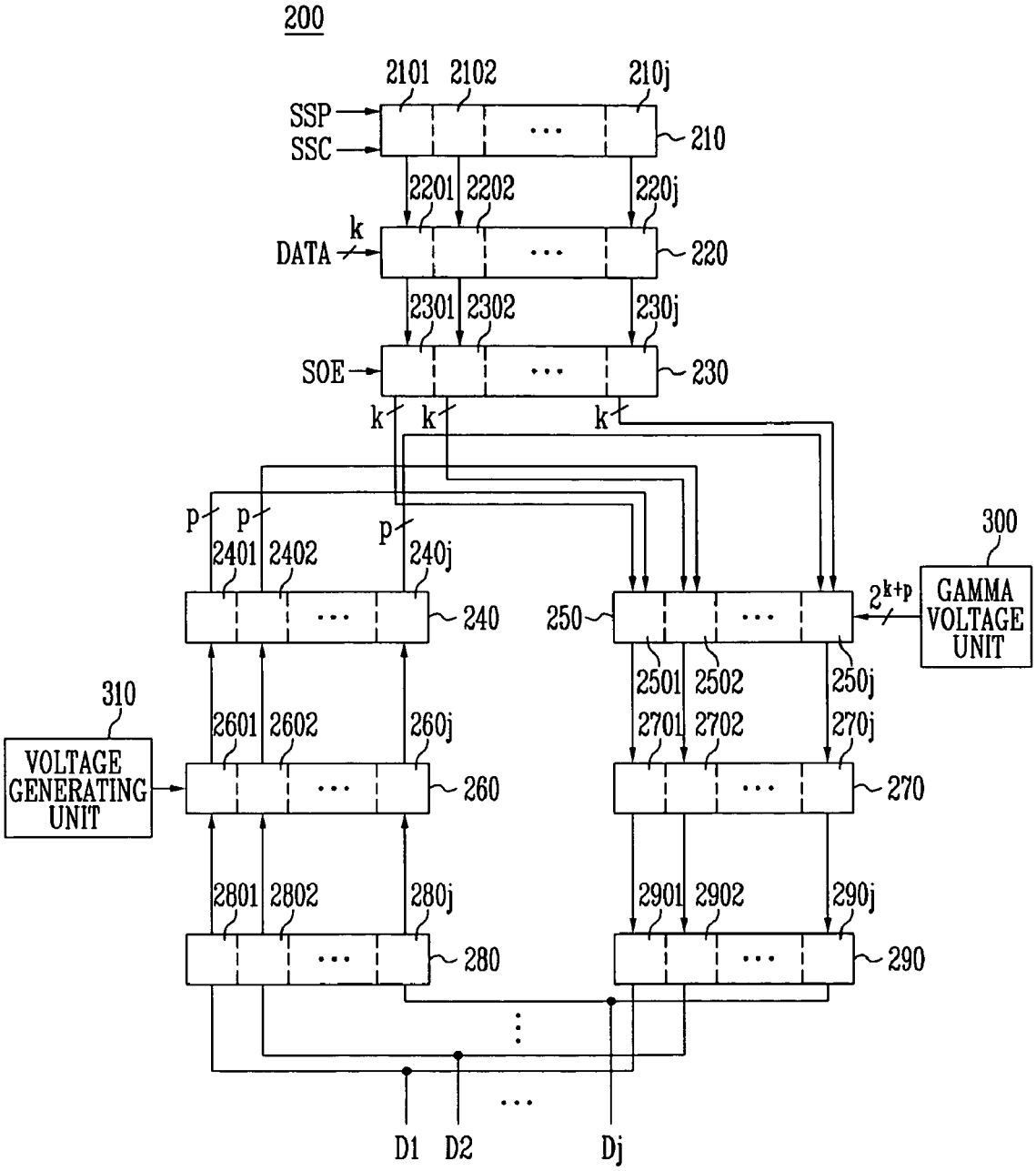
FIG. 6 illustrates a block diagram of a first embodiment of the data driving circuit illustrated in FIG. 2.

FIG. 6 illustrates a block diagram of a first embodiment of the data driving circuit illustrated in FIG. 2. For simplicity, in FIG. 6, it is assumed that the data driving circuit 200 has j channels, where j is a natural number equal to or greater than 2.

As shown in FIG. 6, the data driving circuit 200 may include a shift register unit 210, a sampling latch unit 220, a holding latch unit 230, a compensation unit 240, a digital-analog converter unit (hereinafter, referred to as "DAC unit") 250, a comparator unit 260, a first buffer 270, a current supply unit 280, a selector 290, a gamma voltage unit 300 and voltage generating unit 310.

The shift register unit 210 may receive a source shift clock SSC and a source start pulse SSP from the timing controller 150. The shift register unit 210 may utilize the source shift clock SSC and the source start pulse SSP to sequentially generate j sampling signals while shifting the source start pulse SSP every one period of the source shift clock SSC. The shift register unit 210 may include j shift registers 2101 to 210*j*.

The sampling latch unit 220 may sequentially store the respective data DATA in response to sampling signals sequentially supplied from the shift register unit 210. The sampling latch unit 220 may include j sampling latches 2201 to 220*j* in order to store the j data DATA. Each of the sampling latches 2201 to 220*j* may have a magnitude corresponding to a number of bits of the data DATA. For example, when the data DATA is composed of k bits, each of the sampling latches 2201 to 220*j* may have a magnitude of k bits.

The holding latch unit 230 may receive the data DATA from the sampling latch unit 220 to store the data DATA when a source output enable SOE signal is input. The holding latch unit 230 may supply the data DATA stored therein when the SOE signal is input to the DAC unit 250. The holding latch unit 230 may include j holding latches 2301 to 230*j* in order to store the j data DATA. Each of the holding latches 2301 to 230*j* may have a magnitude corresponding to a number of bits of the data DATA. For example, each of the holding latches 2301 to 230*j* may have a magnitude of k bits so that the respective data DATA may be stored.

The current supply unit 280 may sink the PC from the pixels 140 connected to the data lines D1 to Dj during the first period of the one horizontal period. For example, the current supply unit 280 may sink the current from each of the pixels 140. As discussed below, the amount of current that each pixel may sink to the current supply unit 280 may correspond to or may be greater than a minimum amount of current to be supplied to the respective light emitter, e.g., OLED, for the respective one of the pixels 140 to emit light with the maximum brightness. The current supply unit 280 may help enable predetermined compensation voltages to be respectively generated when the respective currents sink to the second buffer unit 260. The current supply unit 280 may include j current sinks 2801 to 280*j*.

Figure 9:
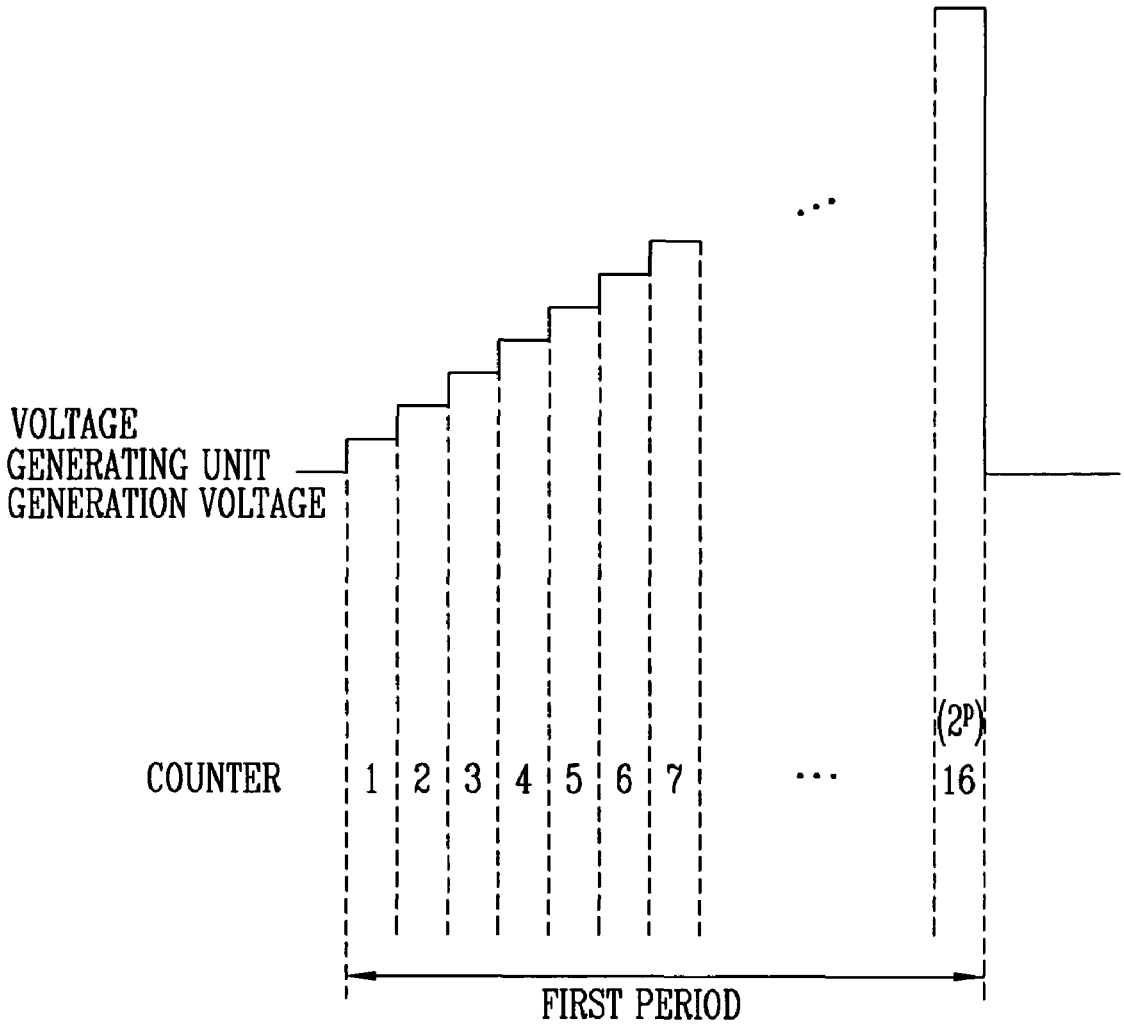
FIG. 9 illustrates a general pattern of a voltage generated by the voltage generating unit of FIG. 8.

The voltage generating unit 310 may generate a voltage, e.g., a compare voltage, during the first period of a horizontal period 1H. As shown in FIG. 9, the compare voltage may rise in a step-wise manner. The voltage generating unit 310 may supply the generated compare voltage to the comparator unit 260. The comparator unit 260 may include a comparator 2601 to 260*j* for each of the j channels. In embodiments of the invention, the voltage generating unit 310 may supply the generated compare voltage to the comparators 2601 to 260*j* associated with each of the j channels.

The comparator unit 260 may compare the compensation voltage supplied from the current sinks 2801 to 280*j* with the compare voltage supplied from the comparators 2601 to 260*j*.

The comparator unit 260 may supply j logic signals, corresponding to comparison results of the respective comparisons, to the compensation unit 240. For example, each of the comparators 2601 to 260*j* may generate a logic signal when a voltage of the step-wise increasing compare voltage surpasses the respective compensation voltage, and each comparator 2601 to 260*j* may supply the respective logic signal(s) corresponding to the respective comparison result to the compensation unit 240.

The compensation unit 240 may include j compensators 2401 to 240*j*, respectively associated with each of the j channels. Each of the compensators 2401 to 240*j* may generate compensation data in accordance with an input timing of the respective logic signal(s) inputted from the respective comparator 2601 to 260*j*, and may supply the generated compensation data to the DAC unit 250. In the following description, for simplicity, it will be assumed that each of the compensators 2401 to 240*j* generates p-bits of compensation data, where p is a natural number.

The DAC unit 250 may include j numbers of DACs 2501 to 250*j*. Each of the DACs 2501 to 250*j* may receive k-bit(s) of data DATA from one of the holding latches 2301 to 230*j* and p-bit(s) of compensation data from one of the compensators 2401 to 240*j*. Based on the received k-bit(s) of data DATA from the respective holding latch 2301 to 230*j* and p-bit(s) of compensation data from the respective compensator 2401 to 240*j*, the DACs 2501 to 250*j* may respectively generate composite data.

The DAC 2501 to 250*j* may generate the composite data by arranging the k-bits of data DATA as the higher bits including the most significant bit MSB and may arrange the p-bits of compensation data as the lower bits including the least significant bit LSB. Based on the generated composite data, the DAC 2501 to 250*j* may select, as a data signal DS1 to DSj, one gradation voltage out of the plurality of gradation voltages generated by the gamma voltage unit 300. The DAC 2501 to 250*j* may select one of the gradation voltages based on the bit value of the (k+p) bits composite data.

Figure 8:
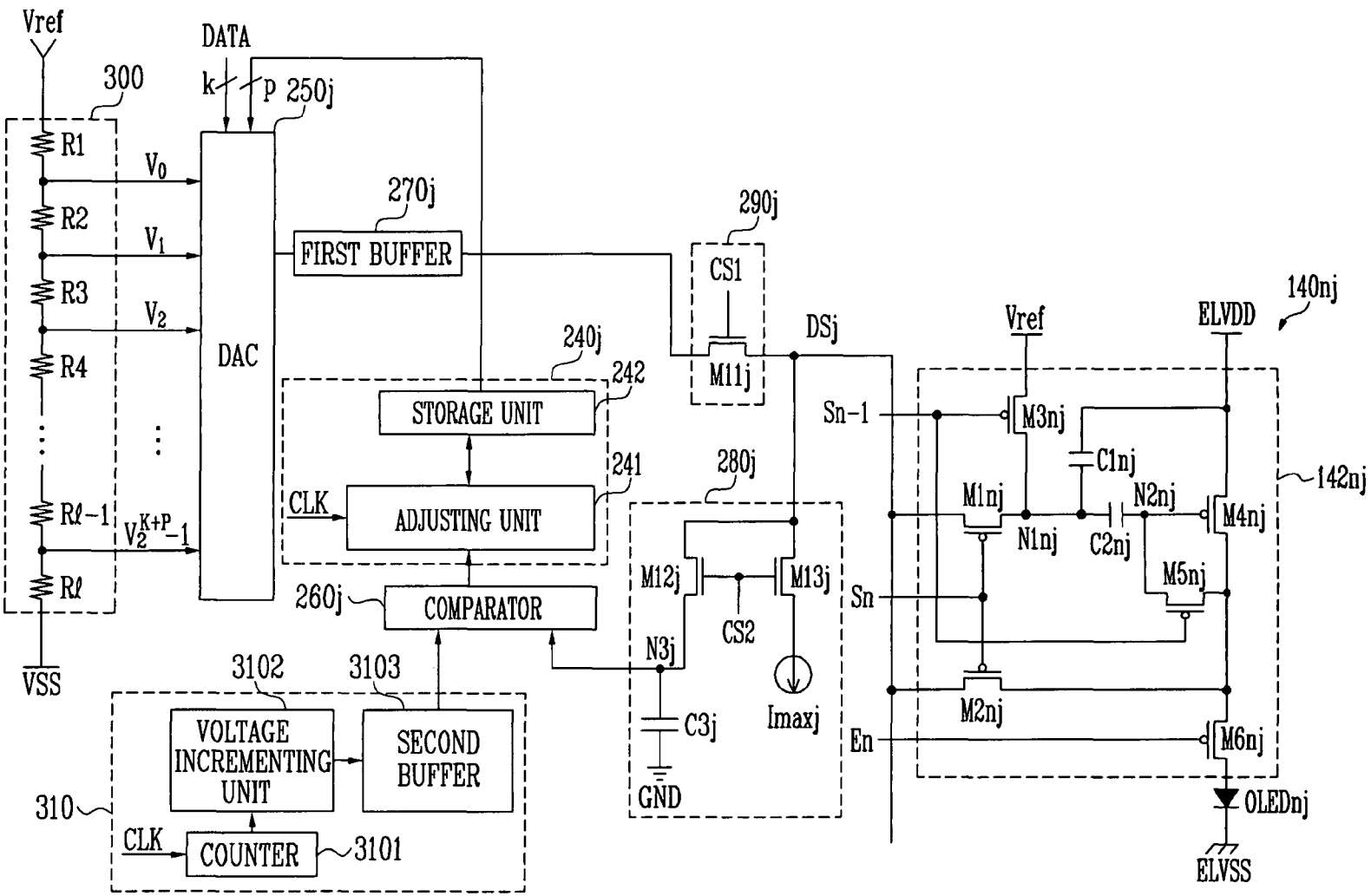
FIG. 8 illustrates a schematic diagram of a first embodiment of a connection scheme connecting the voltage generator, the digital-analog converter, the first buffer, the gamma voltage generator, the comparator, the compensation unit, the switching unit, the current sink unit illustrated in FIG. 6 and the pixel illustrated in FIG. 3.

The gamma voltage unit 300 may supply a predetermined number of gradation voltages to the DAC unit 250. As illustrated in FIG. 8, the gamma voltage unit 300 may include a plurality of voltage-dividing resistors R1 to R/ to generate the $2^{k+p}$ numbers of gradation voltages. The gradation voltages generated by the gamma voltage unit 300 may be supplied to each of the DACs 2501 to 250*j*. In embodiments of the invention, the data driving circuit 200 may include only one gamma voltage unit 300.

The first buffer 270 may supply the respective data signals DS1 to DSj, from the DAC unit 250, to the selector 290. Therefore, in embodiments of the invention, the first buffer 270 may include j first buffers 2701 to 270*j* and/or the selector 290 may include j switching units 2901 to 290*j*. The j 2701 to 270*j* first buffers may respectively supply data signals DS1 to DSj, selected by the respective DACs 2501 to 250*j*, to the respective switching units 2901 to 290*j*.

The selector 290 may control the electrical connection between the data lines D1 to Dj and the first buffers 2701 to 270*j*. The selector 290 may electrically connect the data lines D1 to Dj to the first buffers 2701 to 270*j* during the second period of the first horizontal period or any period of the horizontal period other than the first period. In embodiments of the invention, the selector 290 may electrically connect the data lines D1 to Dj to the first buffers 2701 to 270*j* only during the second period of the first horizontal period. The selector 290 may keep the data lies D1 to Dj electrically disconnected from the first buffers 2701 to 270*j* during period(s) other than the second period of each horizontal period.

Figure 7:
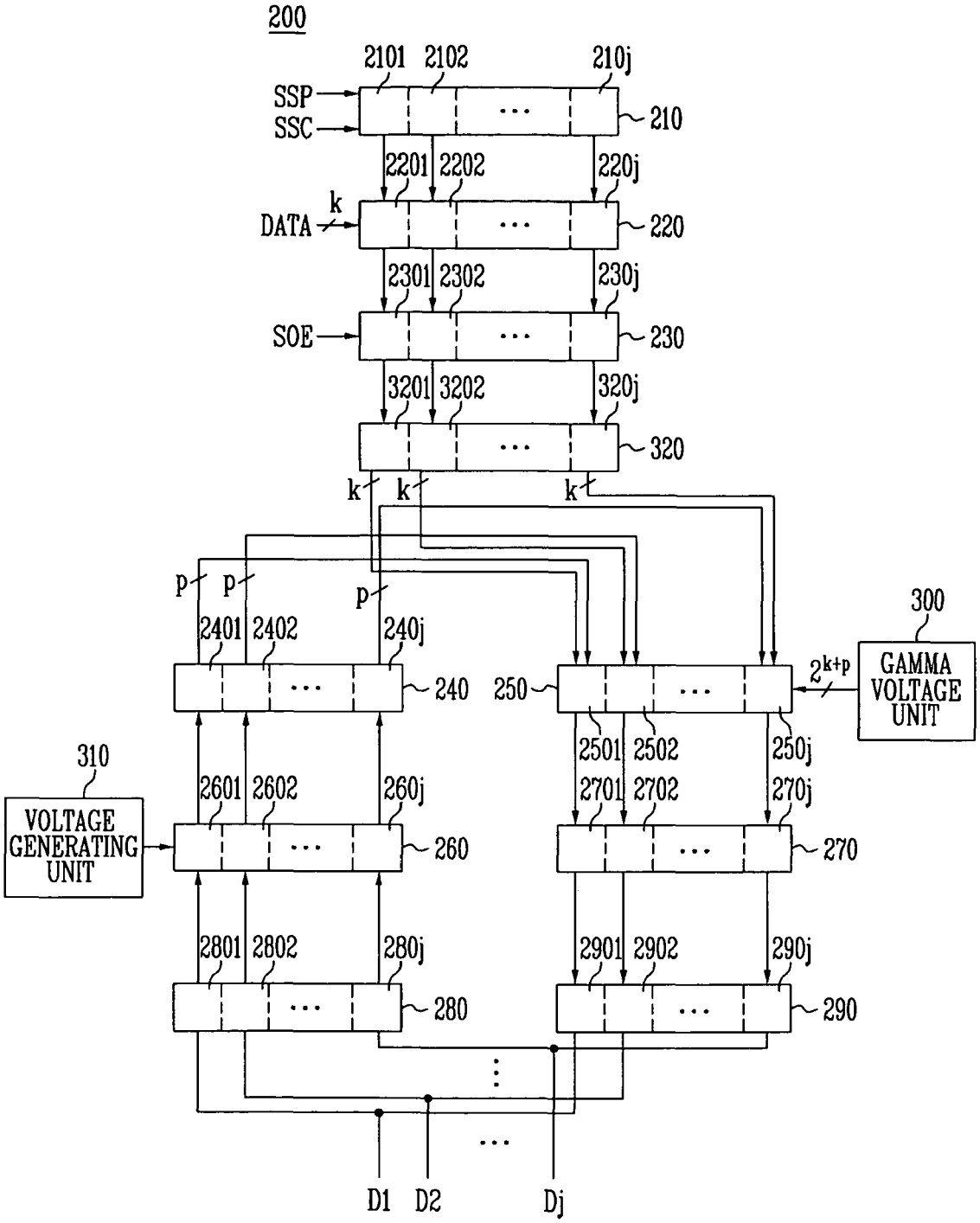
FIG. 7 illustrates a block diagram of a second embodiment of the data driving circuit illustrated in FIG. 2.

As shown in FIG. 7, in a second exemplary embodiment of one or more aspects of the invention, a data driving circuit 200 may include a level shifter unit 320 that may be connected to the holding latch unit 230. The level shifter unit 320 may raise the voltage level of data supplied DATA from the holding latch unit 230 and may supply the level-shifted result to the DAC unit 250. When the data DATA being supplied from an external system to the data driving circuit 200 has high voltage levels, circuit components with high voltage resistant properties should generally be provided, thereby increasing the manufacturing cost. In embodiments of the invention, the data DATA being supplied from an external system to the data driving circuit 200 may have low voltage levels and the low voltage level may be transitioned to a high voltage level by the level shifter 320.

FIG. 8 illustrates a schematic diagram of a first embodiment of a connection scheme connecting the gamma voltage unit 300, the voltage generating unit 310, the digital-analog converter (DAC) unit 250*j*; the first buffer 270*j*, the compensation unit 240*j*, the switching unit 290*j*, the comparator 260*j*, the current sink 280*j* as shown in FIG. 6 and an nj-th pixel 140*nj*. For simplicity, FIG. 8 only illustrates one channel, i.e., the jth channel and it is assumed that the data line Dj is connected to the nj-th pixel 140*nj* according to the exemplary embodiment of the pixel 140*nm* illustrated in FIG. 3.

As shown in FIG. 8, the gamma voltage unit 300 may include a plurality of voltage-dividing or distributing resistors R1 to R/. The voltage-dividing resistors R1 to R/ may be interposed between the reference power source Vref and a third power supply voltage VSS'. The voltage-dividing resistors R1 to R/ may divide the voltage between the reference power source Vref and the third power supply voltage VSS' to generate a plurality of gradation voltages (V0 to V$2^{k+p}$−1), and may supply the generated gradation voltages (V0 to V$2^{k+p}$−1) to the DAC 250*j*. In embodiments of the invention, a same power source or a different power source, e.g., ELVSS, may be employed for supplying the second voltage VSS signal and the third supply voltage VSS' signal.

The voltage generating unit 310 may include a counter 3101, a voltage incrementing unit 3102 and a second buffer 3103. The counter 3101 may be a p-bit counter and may increase in value in predetermined increments, e.g., 1 or 1 bit, every time a signal, e.g., a clock signal CLK, is inputted. The counter 3101 may only operate during the first period of the horizontal period 1H. As illustrated in FIG. 9, the counter 3101 may generate a counter signal that increases by 1 with every clock signal CLK, e.g., every time the clock signal changes from a high signal to a low signal or from a low signal to a high signal, during the first period of the horizontal period. The counter 3101 may supply the generated counter signal to the voltage incrementing unit 3102. In FIG. 9, $2^p$ is shown as having the value 16, but p may be any natural number.

The voltage incrementing unit 3102 may generate a voltage increasing, e.g., in the staircase-like manner, in response to an increase in the value of the counter signal output by the counter 3101. The voltage incrementing unit 3102 may supply the generated voltage to the second buffer 3103. The second buffer 3103 may supply the voltage input from the voltage incrementing unit 3102 to the comparator 260*j*. In embodiments of the invention, the same voltage generating unit 310 may supply the generated voltage to all, some or only one of the comparators 2601-260*j* . . . 260*m*.

As shown in FIG. 8, the current sink 280*j* may include a twelfth transistor M12*j*, a thirteenth transistor M13*j*, a current source Imaxj and a third capacitor C3*j*. The current source Imaxj may be connected to a first electrode of the thirteenth transistor M13*j*. The third capacitor C3*j* may be connected between a third node N3*j* and a ground voltage source GND. The twelfth and thirteenth transistors M12*j* and M13*j* may be controlled by a second control signal CS2. A first electrode of the twelfth transistor M12 may also be connected to the third node N3*j*.

A gate electrode of the twelfth transistor M12*j* may be connected to a gate electrode of the thirteenth transistor M13*j*. The gate electrodes of the twelfth and thirteenth transistors M12*j*, M13*j* may receive the second control signal CS2. A second electrode of the twelfth transistor M12*j* may be connected to a second electrode of the thirteenth transistor M13*j* and the data line Dj. The first electrode of the twelfth transistor M12*j* may be connected to the second buffer 260*j*. The twelfth transistor M12*j* may be turned on during the first period of the one horizontal period 1H by the second control signal CS2 and may be turned off during the second period of the one horizontal period 1H.

The gate electrode of the thirteenth transistor M13*j* may be connected to the gate electrode of the twelfth transistor M12*j* and the second electrode of the thirteenth transistor may be connected to the data line Dj. The first electrode of the thirteenth transistor M13*j* may be connected to the current source Imaxj. The thirteenth transistor M13*j* may be turned on by the second control signal CS2 during the first period of the one horizontal period 1H and may be turned off during the second period of the one horizontal period 1H.

During the first period when the twelfth and thirteenth transistors M12*j* and M13*j* may be turned on, the current source Imaxj may function as a current sink and may receive, from the respective pixel 140*nj*, the minimum current that may be required by the light emitter, e.g., OLED, to enable the pixel 140*nj* to emit light with the maximum brightness.

The third capacitor C3*j* may store the compensation voltage applied to the third node N3*j* when the current is being supplied by the respective pixel 140*nj* to the current source Imaxj. The third capacitor C3*j* may charge the compensation voltage applied to the third node N3*j* during the first period and may maintain the compensation voltage of the third node N3*j* uniform even if the twelfth and thirteenth transistors M12*j* and M13*j* are turned off.

As discussed above, the comparator 260*j* may compare the voltage supplied from the second buffer 3103 with the compensation voltage supplied from the current sink 280*j* and may supply a logic signal to the compensator 240*j* based on the comparison result. The comparator 260*j* may generate the logic signal when a voltage supplied from the second buffer 3103 is determined to have a value equal to or greater than a voltage value of the compensation voltage. When it is determined that the voltage supplied from the second buffer 3103 has a value equal to or greater than a voltage value of the compensation voltage, the comparator 260*j* may supply the compensation voltage and/or the logic signal to the compensator 240*j*. In embodiments of the invention, the comparator 260*j* may only supply the compensation voltage to the compensator 240*j* when it is determined that the voltage supplied from the second buffer 3103 has a value equal to or greater than a voltage value of the compensation voltage.

The comparators 2601 to 260*j* respectively associated with the j channels may generate the respective logic signals at the same or at different times. In embodiments of the invention, each of the comparators 2601 to 260*j* may generate the respective logic signal based on a voltage value of the respective compensation voltage. For example, during one horizontal period 1H, e.g., nth horizontal period, the nth pixels 140*n* in each of the j channels, i.e., 140*n*1, 140*n*2 . . . 140*nj*, may be driven and each of the pixels 140*n*1, 140*n*2 . . . 140*nj*, may respectively supply a compensation voltage to the respective comparator 2601 to 260*j* when the voltage supplied from the respective second buffer 3103 has a value equal to or greater than a voltage value of the respective compensation voltage.

Exemplary methods for providing respective compensation voltages to compensate for, e.g., differences in electron mobilities among different transistors of pixels in a pixel unit will be described below. The compensation voltage respectively supplied to the j current sinks 2801 to 280*j* may be determined based on characteristics of the respective pixel 140 of each of the j channels being driven during a respective-horizontal period.

As shown in FIG. 8, the compensator 240*j* may include an adjusting unit 241 and a storage unit 242. Although only compensator 240*j* is illustrated, the features described herein may apply to each of the compensators 2401 to 240*j*. For example, each of the compensators 2401 to 240*j* may respectively include an adjusting unit and a storage unit such that in an embodiment with j channels, there may be j adjusting units and j storage units.

The adjusting unit 241 may increase the p-bit compensation data value one "1" bit each time a clock signal CLK is input. In embodiments of the invention, the adjusting unit 241 may supply the p-bit compensation data, as compensation data, to the storage unit 242 when the logic signal is inputted from the comparator 260*j*. The bit value of the compensation data may be determined based on when the logic signal is input from the comparator 260*j*. Thus, in embodiments of the invention, the later the respective logic signal is supplied by the comparator 260*j*, the more the bit value may be incremented, thereby resulting in a higher bit value being established for the compensation data. The earlier the logic signal is supplied by the comparator 260*j*, the less the bit value may be incremented, thereby resulting in a lower bit value being established for the compensation data.

The storage unit 242 may temporarily store the compensation data supplied by the adjusting unit 241. The stored compensation data may be supplied to the DAC 250*j*.

As discussed above, the DAC 250*j* may use k-bit(s) of DATA and p-bit(s) of compensation data to generate k+p bit(s) of composite data and the DAC 250*j* may select, one gradation voltage of the plurality of gradation voltages (V0 to V$2^{k+p}-1$), as the data signal DSj, in response to the bit value of the generated composite data. The selected one of the plurality of gradation voltages (V0 to V$2^{k+p}-1$) may be supplied to the first buffer 270*j*. In embodiments of the invention, the p-bit(s) of compensation data, which may correspond to the lower bits of the composite data, may be determined by the voltage value of the compensation data, such that even if the mobilities of the transistors contained in the pixel 140 are not uniform, the pixel unit 130 may be capable of displaying uniform images In embodiments of the invention, the data driving circuit 200 may use compensation voltage, which may be generated based on characteristics, e.g., mobility, threshold voltage, etc., of transistor(s) in the pixels 140 to generate the compensation data and the data driving circuit 200 may select the data signal DS corresponding to the value of the compensation data, thereby enabling compensation for disparities, e.g., differences in electron mobilities and/or threshold voltages of the transistors.

Figure 10:
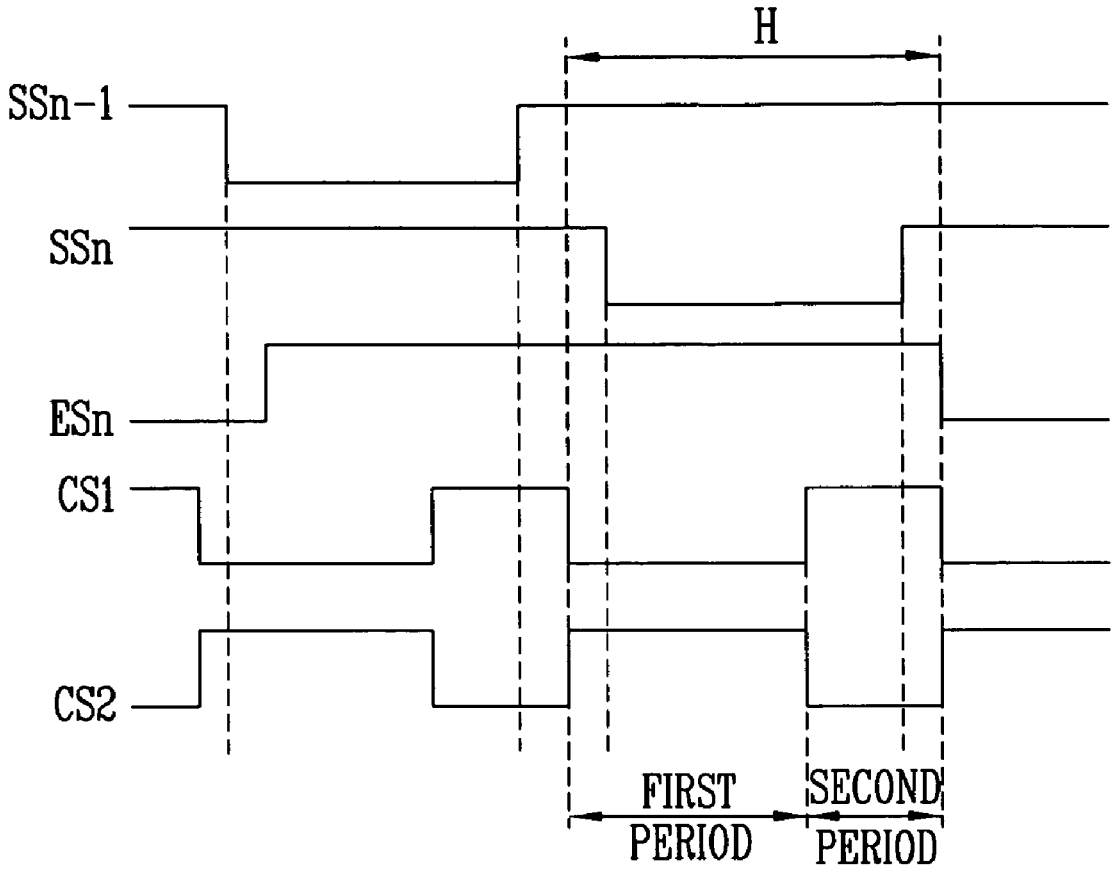
FIG. 10 illustrates exemplary waveforms employable for driving the pixel, the switching unit and the current sink illustrated in FIG. 8.

As shown in FIG. 8, the first buffer 270*j* may transmit the data signal DSj supplied by the DAC 250*j* to the switching unit 290*j*. The switching unit 290*j* may include an eleventh transistor M11*j*. The eleventh transistor M11*j* may be controlled by the first control signal CS1, as illustrated in FIG. 10. In embodiments of the invention, the eleventh transistor M11*j* may be turned on during the second period of one horizontal period 1H and may be turned off during the first period of the one horizontal period. As a result, the data signal DSj may be supplied to the data line Dj during the second period of the horizontal period 1H, and may not supplied during other periods of the one horizontal period 1H.

FIG. 10 illustrates exemplary waveforms employable for driving the pixel, the switching unit 290*j* and the current sink unit 280*j* illustrated in FIG. 8. Exemplary methods for generating respective data signals DS1 to DSj to be supplied to the pixel 140 will be explained in detail with reference to FIGS. 8 and 10. In the following description, the same reference numerals employed above in the description of the nm-th pixel 140*nm* shown in FIG. 3 will be employed to describe like features in the exemplary embodiment of the nj-th pixel 140*nj* illustrated in FIG. 8.

First, the scan signal SSn-1 may be supplied to the n−1th scan line Sn-1. When the scan signal SSn-1 is supplied to the n−1th scan line Sn-1, the third and fifth transistors M3*nj* and M5*nj* may be turned on. The voltage value obtained by subtracting the threshold voltage of the fourth transistor M4*nj* from the first power source ELVDD may then be applied to a second node N2*nj* and the voltage of the reference power source ELVref may be applied to a first node N1*nj*. The voltage corresponding to the voltage drop of the first power source ELVDD and the threshold voltage of the fourth transistor M4*nj* may then be charged in the second capacitor C2*nj*.

The voltages applied to the first node N1*nj* and the second node N2*nj* may be represented by EQUATION1 and EQUATION2.

$$V_{N1}=\text{Vref} \quad \text{[EQUATION1]}$$

$$V_{N2}=ELVDD-|V_{thM4}| \quad \text{[EQUATION2]}$$

In EQUATION1 and EQUATION2, $V_{N1}$, $V_{N2}$, and $V_{thM4}$ represent the voltage applied to the first node N1*nj*, the voltage applied to the second node N2*nj*, and the threshold voltage of the fourth transistor M4*nj*, respectively.

From the time when the scan signal SSn-1 is supplied to the n−1th scan line Sn-1 is turned off to the time when the scan signal SSn is supplied to the nth scan line Snj, the first and second nodes N1*nj* and N2*nj* may be floating. Therefore, the voltage value charged in the second capacitor C2*nj* may not change during that time.

The n-th scan signal SSn may then be supplied to the nth scan line Sn so that the first and second transistors M1*nj* and M2*nj* may be turned on. When the scan signal SSn is being supplied to the nth scan line Sn, during the first period of the one horizontal period when the n-th scan line Sn is being driven, the twelfth and thirteenth transistors M12*j* and M13*j* may be turned on. When the twelfth and thirteenth transistors M12*j* and M13*j* are turned on, the current that may flow through the current source Imaxj via the first power source ELVDD, the fourth transistor M4*nj*, the second transistor M2*nj*, the data line Dj, and the thirteenth transistor M13*j* may sink.

When current flows through the current source Imaxj via the first power source ELVDD, the fourth transistor M4*nj* and the second transistor M2*nj*, EQUATION3 may apply.

$$I_{max}=\frac{1}{2}\mu_p C_{ox}\frac{W}{L}(ELVDD-V_{N2}-|V_{thM4})^2| \quad \text{[EQUATION3]}$$

In EQUATION3, μ, Cox, W and L represent the electron mobility, the capacity of an oxide layer, the width of a channel and the length of a channel, respectively.

The voltage applied to the second node N2*nj* when the current obtained by EQUATION3 flows through the fourth transistor M4*nj* may be represented by EQUATION4.

$$V_{N2}=ELVDD-\sqrt{\frac{2I\max}{\mu_p C_{ox}}\frac{L}{W}}-|V_{thM4}| \quad \text{[EQUATION4]}$$

The voltage applied to the first node N1*nj* may be represented by EQUATION5 by the coupling of the second capacitor C2*nj*.

$$V_{N1}=Vref-\sqrt{\frac{2I\max}{\mu_p C_{ox}}\frac{L}{W}}=V_{N3} \quad \text{[EQUATION5]}$$

In EQUATION5, the voltage $V_{N1}$ may correspond to the voltage applied to the first node N1*nj*, the voltage $V_{N3}$ may correspond to the voltage applied to the third node N3*j*. In embodiments of the invention, when current sinks by the current source Imaxj, a voltage satisfying EQUATION5 may be applied to the third node N3*j*.

As seen in EQUATION5, the voltage applied to the third node N3*j* may be affected by the electron mobility of the transistors included in the pixel 140*nj*, which is supplying current to the current source Imaxj. Therefore, the voltage value applied to the third node N3*j* when the current is being supplied to the current source Imaxj may vary in each of the pixels 140, e.g., when the electron mobility varies in each of the pixels 140.

The compensation voltage shown in EQUATION5 may be influenced by the mobilities of the transistor(s) contained in the pixel 140*nj*. Accordingly, when the current sinks to the current source Imaxj, the voltage value applied to the third node N3 may be different based on characteristics of the respective pixel 140.

As discussed above, the compensation voltage applied to the third node N3*j* may be supplied to the respective comparator 260*j*. The comparator 260*j* may compare the compare voltage supplied from the voltage generating unit 310 with the compensation voltage supplied from the current sink 280*j* and may supply a logic signal to the compensator 240*j* based on the comparison result. The comparator 260*j* may then generate and supply a logic signal to the compensator 240*j*. The generation time of the logic signal may be determined based on the voltage value of the compensation voltage supplied by the current sink 280*j*.

The compensator 240*j* may generate a compensation data of p-bit(s) in response to the generation time of the logic signal and the generated compensation data may be supplied to the DAC 250*j*. Then, the DAC 250*j* may generate a composite data in response to the k-bit(s) of data DATA and p-bit(s) of compensation data and the DAC 250*j* may select, one gradation voltage out of the plurality of gradation voltages, as the data signal DSj in response to the bit value of the generated composite data. The DAC 250*j* may supply the selected data signal DSj to the first buffer 270*j*. The k-bit(s) of data DATA, which may be externally supplied, and the p-bit (s) of compensation data may be generated in response to the voltage value of the compensation voltage supplied by the respective current sink 280*j*. In embodiments of the invention, the voltage value of the data signal DS may be determined based on characteristics, e.g., mobility, threshold voltage, etc., of transistor(s) of the respective pixel 140 supplying the sinking current.

During a second period of the one horizontal period 1H, the eleventh transistor M11*j* may be turned on. The data signal DSj supplied to the first buffer 270*j* may be supplied to the first node N1*j* via the eleventh transistor M11*j*, the data line Dj and the first transistor M1*nj*. The first capacitor C1*nj* may then be charged with a predetermined voltage corresponding to the data signal DSj.

As shown in FIG. 10, the emission control signal ESn being supplied to the n-th light emitting control line En may be controlled, e.g., changed from a high signal to a low signal, and the sixth transistor M6*nj* may be turned on. Then, the fourth transistor M4*nj* may supply the current corresponding to the voltage charged in the first and second capacitors C1*nj*, C2*nj* to the OLEDnj via the sixth transistor M6*nj*. In embodiments of the invention, because the voltage value of the data signal DSj may be determined by the mobility of the transistor (s) of the respective pixel 140*nj*, the OLEDnj may be supplied with current corresponding to the selected gradation voltage regardless of the characteristics, e.g., threshold voltage of the fourth transistor M4*nj* and the electron mobilities, such that uniform images can be displayed.

Figure 11:
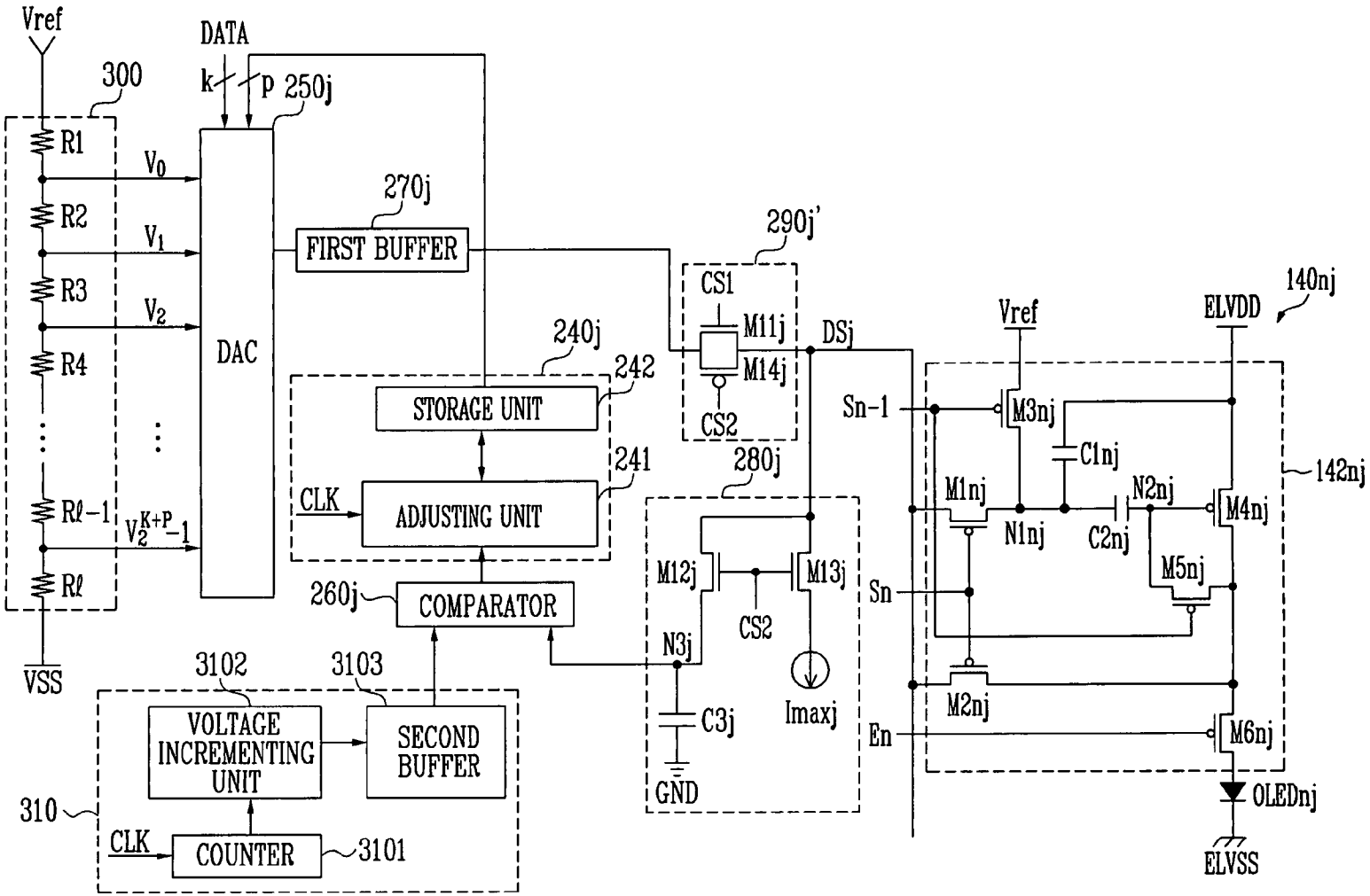
FIG. 11 illustrates the connection scheme illustrated in FIG. 8 employing another embodiment of a switching unit.

In embodiments of the invention, as discussed above, different switching units may be employed. FIG. 11 illustrates the connection scheme illustrated in FIG. 8 employing another embodiment of a switching unit 290*j*'. The exemplary connection scheme illustrated in FIG. 11 is substantially the same as the exemplary connection scheme illustrated in FIG. 8, but for another exemplary embodiment of the switching unit 290*j*'. In the following description, the same reference numerals employed above will be employed to describe like features in the exemplary embodiment illustrated in FIG. 11.

As shown in FIG. 11, another exemplary switching unit 290*j*' may include eleventh and fourteenth transistors M11*j*, M14*j* that may be connected to each other in the form of a transmission gate. The fourteenth transistor M14*j*, which may be a PMOS type transistor, may receive the second control signal CS2. The eleventh transistor M11*j*, which may be a NMOS type transistor, may receive the first control signal CS1. In such embodiments, when the polarity of the first control signal CS1 is opposite to the polarity of the second control signal CS2, the eleventh and fourteenth transistors M11*j* and M14*j* may be turned on and off at the same time.

In embodiments of the invention in which the eleventh and fourteenth transistors M11*j* and M14*j* may be connected to each other in the form of the transmission gate, a voltage-current characteristic curve may be in the form of a straight line and switching error may be minimized.

Figure 12:
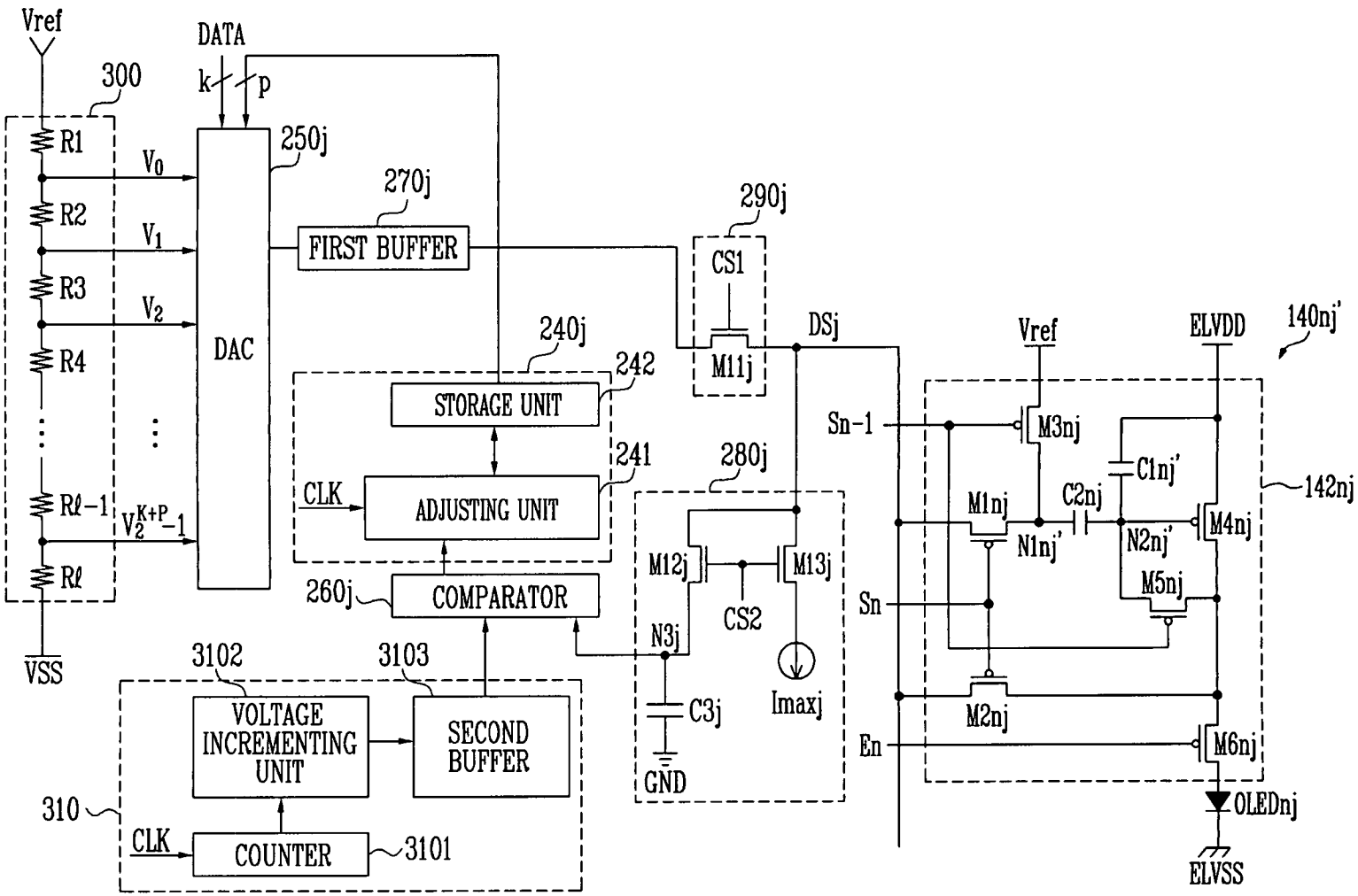
FIG. 12 is a schematic drawing for illustrating a second embodiment of a connection scheme connecting the gamma voltage unit, the voltage generating unit of a data driving circuit, the digital-analog converter for each channel/column of a light emitting display, the first buffer, the comparator, the compensation unit, the switching unit, the current sink illustrated in FIG. 6 and the pixel illustrated in FIG. 5.

FIG. 12 illustrates a schematic diagram of a second exemplary embodiment of a connection scheme connecting, for a specific channel, the gamma voltage unit 300, the voltage generating unit 310, the digital-analog converter (DAC) unit 250, the first buffer 270*j*, the compensation unit 240*j*, the switching unit 290*j*, the comparator 260*j* and the current sink 280*j* as shown in FIG. 6, and an nj-th pixel 140*nj*'. For simplicity, FIG. 12 only illustrates one channel, i.e., the jth channel and it is assumed that the data line Dj is connected to the nj-th pixel 140*nj*' according to the exemplary embodiment of the pixel 140*nm*' illustrated in FIG. 5. The exemplary connection scheme illustrated in FIG. 12 is substantially the same as the exemplary connection scheme illustrated in FIG. 8. In the following description, the same reference numerals employed above will be employed to describe like features in the exemplary embodiment illustrated in FIG. 12. Therefore, the voltages and/or signals supplied to/by the pixel 140*nj*' will be only briefly described below.

As shown in FIG. 12, the first capacitor C1*nj*' of the pixel 140*nj*' may be connected between the first power source ELVDD and the second node N2*nj*'. In embodiments of the invention, e.g., embodiments employing the pixel 140*nj*', even when the voltage of the first node N1*nj*' of the pixel 140*nj*' may be greatly changed, i.e., (C1+C2)/C2, the voltage of the second node N2*nj* may change gradually. As a result of the gradually changing voltage of the second node N2, a greater voltage range may be set for the gamma voltage unit 300 compared with a case where the pixel 140*nm* illustrated in FIG. 3 is employed. When the voltage range of the gamma voltage unit 300 may be greater, switching error of the eleventh transistor M11*j* and the first transistor M1*nj*.

In data driving circuits and methods employing one or more as of the invention, a compensation voltage may be generated based on current supplied to a current sink from the respective pixel and the compensation voltage may be used to generate compensation data. The generated compensation data and externally supplied data may be used to generate composite data. Then the composite data may be used to select one gradation voltage out of a plurality of gradation voltages to enable the display of images with uniform brightness regardless of the characteristics, e.g., threshold voltage, mobility, etc., of the transistors.

Exemplary embodiments of the present invention have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. A data driving circuit for driving a pixel of a light emitting display based on k-bit externally supplied data for the pixel, wherein the pixel is electrically connectable to the driving circuit via a data line, where k is a natural number, the data driving circuit comprising:

a gamma voltage generator generating a plurality of gradation voltages;

a current sink, the current sink receiving a predetermined current from the pixel via the data line during a first partial period of one complete period for driving the pixel;

a voltage generator generating an incrementally increasing compare voltage during the first partial period of the one complete period;

a comparator comparing a compensation voltage generated based on the predetermined current with the incrementally increasing compare voltage and generating a logic signal based on a result of the compare;

a compensation unit generating p-bit compensation data based on the logic signal, where p is a natural number; and a digital-analog converter generating a composite data using the p-bit compensation data and the k-bit externally supplied data and selecting, as a data signal for the pixel, one of the plurality of gradation voltages based on a bit value of the composite data.

2. The data driving circuit as claimed in claim 1, further comprising:

a switching unit supplying the selected data signal to the data line during a second partial period of the one complete period; and a buffer arranged between the digital-converter and the switching unit.

3. The data driving circuit as claimed in claim 2, wherein the switching unit comprises at least one transistor that is turned on during the second partial period.

4. The data driving circuit as claimed in claim 3, wherein the switching unit comprises two transistors that are connected to each other so as to form a transmission gate.

5. The data driving circuit as claimed in claim 1, wherein the gamma voltage generator generates $2^{K+p}$ gradation voltages.

6. The data driving circuit as claimed in claim 1, wherein the generated composite data is (k+p) bits and the digital-analog converter generates the composite data by employing the k-bits of data as higher bits, including a most significant bit, of the (k+p) bit compensation data and employing the p-bits of compensation data as the lower bits, including a least significant bit, of the (k+p) bit compensation data.

7. The data driving circuit as claimed in claim 1, wherein the current sink comprises:

a current source for receiving the predetermined current;

a first transistor provided between the data line and the comparator, the first transistor being turned on during the first partial period;

a second transistor provided between the data line and the current source, the second transistor being turned on during the second partial period; and a capacitor charging the compensation voltage therein.

8. The data driving circuit as claimed in claim 1, wherein a value of the predetermined current is equal to or higher than a value of a minimum current employable by the pixel to emit light of maximum brightness; and the maximum brightness corresponds to a brightness of the pixel when a highest one of the plurality of gradation voltages is applied to the pixel.

9. The data driving circuit as claimed in claim 1, wherein the voltage generator comprises:

a counter generating a count signal based on a clock signal received during the first partial period;

a voltage incrementing unit incrementally increasing a voltage in response to the count signal from the counter and generating the compare voltage; and a buffer arranged between the voltage incrementing unit and the comparator.

10. The data driving circuit as claimed in claim 9, wherein the compensation unit comprises:

a storage unit, the storage unit temporarily storing the p-bit compensation data; and an adjusting unit, the adjusting unit increasing a bit value of the p-bit compensation data based on the clock signal and transmitting the p-bit compensation data to the storage unit based on the logic signal.

11. The data driving circuit as claimed in claim 1, wherein the comparator generates the logic signal when a voltage value of the compare voltage is determined to be greater than or equal to a voltage value of the p-bit compensation voltage.

12. The data driving circuit as claimed in claim 1, further comprising:

a shift register sequentially generating a sampling pulse;

a sampling latch unit including at least one sampling latch for receiving and storing the k-bit externally supplied data based on the sampling pulse; and a holding latch unit receiving the k-bit externally supplied data stored in sampling latch unit and supplying the k-bit externally supplied data stored in the holding latch unit to the digital-analog converter.

13. The data driving circuit as claimed in claim 12, further comprising:

a level shifting unit increasing a voltage level of the k-bit externally supplied data stored in the holding latch unit and supplied the voltage shifted k-bit externally supplied data to the digital-analog converter.

14. A light emitting display, comprising:

a pixel unit including a plurality of pixels connected to one of n scan lines, one of a plurality of emission control lines and one of a plurality of data lines, where n is an integer;

a scan driver, the scan driver respectively and sequentially supplying, during each scan cycle, n scan signals to the n scan lines, and for sequentially and respectively supplying emission control signals to the emission control lines; and a data driving circuit, the data driving circuit:

generating compensation voltages based on predetermined currents flowing to the data lines from the pixels, respectively, during a first partial period of one complete period during which one of n scan signals is applied to the respective one of the n scan lines;

generating a plurality of compensation data using the generated compensation voltages and externally supplied data, wherein generating the plurality of compensation data includes;

generating an incrementally increasing compare voltage during the first partial period of the one complete period;

comparing a compensation voltage generated based on the predetermined current with the incrementally increasing compare voltage and generating a logic signal based on a result of the compare; and generating p-bit compensation data based on the logic signal, where p is a natural number;

selecting one of a plurality of gradation voltages based on the generated compensation data; and supplying the selected one of the plurality of gradation voltages to the respective pixels during a second partial period of the one complete period.

15. The light emitting display as claimed in claim 14, wherein each of the pixels is connected to two of the n scan lines, and during each of the scan cycles, a first scan line of the two scan lines receiving a respective one of the n scan signals before a second scan line of the two scan lines receives a respective one of the n scan signals, and each of the pixels comprises:

a light emitter receiving current from a first power source;

first and second transistors each having a first electrode connected to the respective one of the data lines associated with the pixel, the first and second transistors being turned on when the first of the two scan signals is supplied;

a third transistor having a first electrode connected to a reference power source and a second electrode connected to a second electrode of the first transistor, the third transistor being turned on when the first of the two scan signals is supplied;

a fourth transistor, the fourth transistor controlling an amount of current supplied to the light emitter, a first terminal of the fourth transistor being connected to the first power source; and a fifth transistor having a first electrode connected to a gate electrode of the fourth transistor and a second electrode connected to a second electrode of the fourth transistor, the fifth transistor being turned on when the first of the two scan signals is supplied such that the fourth transistor operates as a diode.

16. The light emitting display as claimed in claim 15, wherein each of the pixels further comprises:

a first capacitor having a first electrode connected to one of a second electrode of the first transistor and the gate electrode of the fourth transistor and a second electrode connected to the first power source; and a second capacitor having a first electrode connected to the second electrode of the first transistor and a second electrode connected to the gate electrode of the fourth transistor.

17. The light emitting display as claimed in claim 15, wherein each of the pixels further comprises:

a sixth transistor having a first terminal connected to the second electrode of the fourth transistor and a second terminal connected to the organic light emitting diode, the sixth transistor being turned off when the respective emission control signal is supplied, wherein the current sink receives the predetermined current from the pixel during the first partial period of one complete period for driving the pixel based on the selected graduation voltage, the first partial period occurring before a second partial period of the complete period for driving the one pixel based on the selected graduation voltage, and the sixth transistor is turned on during the second partial period of the complete period for driving the pixel.

18. A method of driving a pixel of a light emitting display based on k-bit externally supplied data for the pixel, wherein the pixel is electrically connectable to a driving circuit via a data line, the method comprising:

receiving a predetermined current from the pixel via the data line during a first partial period of one complete period for driving the pixel;

generating an incrementally increasing compare voltage during the first partial period of the one complete period;

comparing a compensation voltage generated based on the predetermined current with the incrementally increasing compare voltage and generating a logic signal based on a result of the compare;

generating p-bit compensation data based on the logic signal, where p is a natural number;

generating a composite data using the p-bit compensation data and the k-bit externally supplied data and selecting, as a data signal for the pixel, one of a plurality of gradation voltages based on a bit value of the composite data, where k is a natural number; and supplying the selected data signal to the pixel via the data line during a second partial period of the one complete period for driving the pixel, the first partial period being different from the second partial period.

19. The method of claim 18, wherein generating the logic signal comprises generating the logic signal when a voltage value of the compare voltage is determined to be greater than or equal to a voltage value of the p-bit compensation voltage.

20. The method of claim 18, wherein the composite data is (k+p) bits and generating the composite data comprises employing the k-bits of data as higher bits, including a most significant bit, of the (k+p) bit compensation data and employing the p-bits of compensation data as lower bits, including a least significant bit, of the (k+p) bit compensation data.

* * * * *